US010254090B1

(12) United States Patent
Mohler et al.

(10) Patent No.: US 10,254,090 B1
(45) **Date of Patent: *Apr. 9, 2019**

(54) LAYERED ENERGETIC MATERIAL HAVING MULTIPLE IGNITION POINTS

(71) Applicants: Spectre Materials Sciences, Inc., Melbourne, FL (US); University of Central Florida Research Foundation, Orlando, FL (US)

(72) Inventors: Timothy Mohler, Palm Beach Garden, FL (US); Jonathan Mohler, Vero Beach, FL (US); Kevin R. Coffey, Oviedo, FL (US); Edward Alan Dein, Saint Cloud, FL (US)

(73) Assignees: UNIVERSITY OF CENTRAL FLORIDA RESEARCH FOUNDATION, Orlando, FL (US); SPECTRE MATERIALS SCIENCES, INC., Melbourne, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/730,697

(22) Filed: Oct. 11, 2017

Related U.S. Application Data

(60) Continuation-in-part of application No. 15/242,962, filed on Aug. 22, 2016, now Pat. No. 9,816,792,
(Continued)

(51) Int. Cl.

| | |
|---|---|
| ***F42B 3/10*** | (2006.01) |
| ***F42C 11/06*** | (2006.01) |
| ***C06B 45/14*** | (2006.01) |
| ***F42B 3/195*** | (2006.01) |
| ***C06B 33/00*** | (2006.01) |

(Continued)

(52) U.S. Cl.
CPC ..... *F42B 3/10* (2013.01); *C06B 33/00* (2013.01); *C06B 45/14* (2013.01); *C06C 9/00* (2013.01); *F42B 3/195* (2013.01); *F42C 11/06* (2013.01); *F42C 19/0834* (2013.01); *F42C 19/0846* (2013.01)

(58) Field of Classification Search
CPC .. F42D 1/055; F42C 9/10; F42C 11/06; F42B 3/10; F42B 3/16; F42B 3/195; C06B 45/14; C06B 33/00; C06C 9/00
See application file for complete search history.

(56) References Cited

U.S. PATENT DOCUMENTS

| | | | |
|---|---|---|---|
| 2,239,123 | A | 4/1941 | Stoneking |
| 3,170,402 | A | 2/1965 | Morton et al. |

(Continued)

*Primary Examiner* — Bret Hayes
(74) *Attorney, Agent, or Firm* — William F. Lang, IV; Lang Patent Law LLC

(57) ABSTRACT

An energetic material having thin, alternating layers of metal oxide and reducing metal is provided. The energetic material may be provided in the form of a sheet, foil, cylinder, or other convenient structure. A method of making the energetic material resists the formation of oxide on the surface of the reducing metal, allowing the use of multiple thin layers of metal oxide and reducing metal for maximum contact between the reactants, without significant lost volume due to oxide formation. An ignition system for the energetic material includes multiple ignition points, as well as a means for controlling the timing and sequence of activation of the individual ignition points. A gas producing layer is also provided to increase pressure.

11 Claims, 16 Drawing Sheets

Related U.S. Application Data which is a division of application No. 14/213,750, filed on Mar. 14, 2014, now Pat. No. 9,464,874.

(60) Provisional application No. 61/785,497, filed on Mar. 14, 2013.

(51) Int. Cl.

| | |
|---|---|
| ***F42C 19/08*** | (2006.01) |
| ***F42B 3/11*** | (2006.01) |
| ***C06C 9/00*** | (2006.01) |

(56) References Cited

U.S. PATENT DOCUMENTS

| | | | |
|---|---|---|---|
| 3,896,731 | A | 7/1975 | Kilmer |
| 4,475,461 | A | 10/1984 | Durrell |
| 4,651,254 | A | 3/1987 | Brede et al. |
| 4,823,701 | A | 4/1989 | Wilhelm |
| 4,875,948 | A | 10/1989 | Verneker |
| 4,996,922 | A | 3/1991 | Halcomb |
| 5,266,132 | A | 11/1993 | Danen et al. |
| 5,817,970 | A | 10/1998 | Feierlein |
| 5,854,439 | A | 12/1998 | Almstrom et al. |
| 6,183,569 | B1 | 2/2001 | Mohler |
| 6,334,394 | B1 | 1/2002 | Zimmerman et al. |
| 6,363,853 | B1 | 4/2002 | Rohr |
| 6,679,960 | B2 | 1/2004 | Jones |
| 6,712,917 | B2 | 3/2004 | Gash et al. |
| 6,805,832 | B2 | 10/2004 | Mohler et al. |
| 6,843,868 | B1 | 1/2005 | Fawls et al. |
| 6,962,112 | B1 | 11/2005 | Kern |
| 7,886,668 | B2 | 2/2011 | Hugus et al. |
| 7,896,988 | B2 | 3/2011 | Mohler |
| 7,955,451 | B2 | 6/2011 | Hugus et al. |
| 7,998,290 | B2 | 8/2011 | Sheridan et al. |
| 8,298,358 | B1 | 8/2012 | Coffey et al. |
| 8,465,608 | B1 | 6/2013 | Coffey et al. |
| 8,591,676 | B2 | 11/2013 | Coffey et al. |
| 9,464,874 | B1 | 10/2016 | Mohler et al. |
| 9,709,366 | B1 | 7/2017 | Mohler et al. |
| 2007/0169862 | A1 | 7/2007 | Hugus et al. |
| 2007/0272112 | A1 | 11/2007 | Nielson et al. |
| 2008/0047453 | A1 | 2/2008 | Dahlberg |
| 2009/0139422 | A1 | 6/2009 | Mohler |
| 2010/0193093 | A1 | 8/2010 | Coffey et al. |
| 2010/0282115 | A1 | 11/2010 | Sheridan et al. |
| 2011/0308416 | A1 | 12/2011 | Bar et al. |
| 2012/0132096 | A1 | 5/2012 | Chin et al. |

LAYERED ENERGETIC MATERIAL HAVING MULTIPLE IGNITION POINTS

CROSS REFERENCE TO RELATED APPLICATION

This application is continuation in part of U.S. patent application Ser. No. 15/242,962, which was filed on Aug. 22, 2016 and entitled "Layered Energetic Material Having Multiple Ignition Points." which is a division of U.S. patent application Ser. No. 14/213,750, which was filed on Mar. 14, 2014, and entitled "Layered Energetic Material Having Multiple Ignition Points," which claims the benefit of U.S. provisional patent application No. 61/785,497, which was filed on Mar. 14, 2013, and entitled "Layered Energetic Material Having Multiple Ignition Points.

TECHNICAL FIELD

The present invention relates to energetic materials. More specifically, a structure formed from alternating layers of metal oxides and reducing metals, with multiple ignition points, is provided.

BACKGROUND INFORMATION

Energetic materials such as thermite are presently used when highly exothermic reactions are needed. Uses include cutting, welding, purification of metal ores, and enhancing the effects of high explosives. A thermite reaction occurs between a metal oxide and a reducing metal. Examples of metal oxides include $La_2O_3$, AgO, $ThO_2$, SrO, $ZrO_2$, $UO_2$, BaO, $CeO_2$, $B_2O_3$, $SiO_2$, $V_2O_5$, $Ta_2O_5$, NiO, $Ni_2O_3$, $Cr_2O_3$, $MoO_3$, $P_2O_5$, $SnO_2$, $WO_2$, $WO_3$, $Fe_3O_4$, CoO, $Co_3O_4$, $Sb_2O_3$, PbO, $Fe_2O_3$, $Bi_2O_3$, $MnO_2$, $Cu_2O$, and CuO. Example reducing metals include Al, Zr, Th, Ca, Mg, U, B, Ce, Be, Ti, Ta, Hf, and La. The reducing metal may also be in the form of an alloy or intermetallic compound of the above-listed metals.

An example of the use of thermite to enhance high explosives is U.S. Pat. No. 7,955,451 disclosing energetic thin-film-based reactive fragmentation weapons. The weapons include conventional high explosives with reactive fragments mixed within the high explosives. The reactive fragments are made by alternating layers of metal oxides and reducing metals that are selected to produce thermite reactions. The metal oxides and reducing metals are deposited into layers utilizing chemical or physical deposition, vacuum deposition, sputtering, mechanical rolling, or ball milling. Individual layers are typically about 10 nm to about 1000 nm thick. The alternating layers are then removed from the substrate and reduced in size. The resulting pieces are then mixed with a binder, and then shaped into reactive fragments. The reactive fragments are mixed with high explosive and placed inside a warhead. When the warhead strikes a target, the reactive fragments are preferably driven into the target before the reaction occurs. Ensuring that the reactive fragments are in fact driven into the target before the reaction occurs can be accomplished by constructing the alternating layers of metal oxides and reducing metals so that those having the highest reactivity are towards the interior of the energetic material, while those having a lower reactivity are on the periphery (the top or the bottom). Additionally, the speed of the reaction can be controlled by controlling the thickness of the metal oxide and reducing metal layers, with a greater number of thinner layers producing greater contact between the metal and metal oxide, and faster reaction rates. This use of thermite to enhance high explosives fails to disclose that a layered thermite structure, by itself, provides numerous advantages over the reactive fragments disclosed by this patent.

U.S. Pat. No. 7,886,668 discloses metal matrix composite energetic structures for use in munitions. The composite energetic structures are made by alternating layers of metal oxides and reducing metals that are selected to produce thermite reactions. The metal oxides and reducing metals are deposited into layers utilizing chemical or physical deposition, vacuum deposition, sputtering, mechanical rolling, or ball milling. Individual layers are typically about 10 nm to about 1000 nm thick. The alternating layers are then removed from the substrate and reduced in size. The resulting pieces are then mixed with a binder that is selected to increase the density of the overall mixture. This increased density increases the ballistic effectiveness of a munition in which the composite energetic material is placed. The reaction of the energetic material is delayed by constructing the alternating layers of metal oxides and reducing metals so that those having the highest reactivity are towards the interior of the energetic material, while those having a lower reactivity are on the periphery (the top or the bottom). Additionally, the speed of the reaction can be controlled by controlling the thickness of the metal oxide and reducing metal layers, with a greater number of thinner layers producing greater contact between the reducing metal and metal oxide, and faster reaction rates. This use of fragmented thermite material fails to provide the numerous advantages of retaining a layered structure of thermite material, as described below.

U.S. Pat. No. 7,998,290 discloses an enhanced blast explosive utilizing a composite explosive material having a high explosive as well as energetic material dispersed within the high explosive. The composite energetic structures are made by alternating layers of metal oxides and reducing metals that are selected to produce thermite reactions. The metal oxides and reducing metals are deposited into layers utilizing chemical or physical deposition, vacuum deposition, sputtering, mechanical rolling, or ball milling. Individual layers are typically about 10 nm to about 1000 nm thick. The alternating layers are then removed from the substrate and reduced in size. These reduced size pieces are mixed with the high explosive. The energetic material increases the overpressure duration of the blast, thereby increasing lethality for a given pressure level. The reaction of the energetic material is delayed by constructing the alternating layers of metal oxides and reducing metals so that those having the highest reactivity are towards the interior of the energetic material, while those having a lower reactivity are on the periphery (the top or the bottom). Additionally, the speed of the reaction can be controlled by controlling the thickness of the metal oxide and reducing metal layers, with a greater number of thinner layers producing greater contact between the metal and metal oxide, and faster reaction rates. This use of thermite to enhance high explosives fails to disclose that a layered thermite structure, by itself, provides numerous advantages over the reactive fragments disclosed by this patent.

US 2007/0169862 discloses an energetic thin-film initiator. At least one fuel layer and oxidizer layer are provided on a substrate. A pair of electrical conductors are connected to the structure to provide an electrical impulse. The resulting reaction ignites a secondary energetic material.

U.S. Pat. No. 6,712,917 discloses a hybrid inorganic/organic energetic composite made from metal inorganic salts, organic solvents, and organic polymers. Fuel metal powder is also included in the composition.

U.S. Pat. No. 6,679,960 discloses an energy dense explosive wherein particles of a reducing metal and a metal oxide are dispersed throughout a high explosive. The particle size and packing density are varied to control the blast characteristics. The reducing metal, metal oxide, and high explosive are suspended in a polymeric binder or matrix. The particles of reducing metal and metal oxide may be mechanically bonded prior to suspension in the polymer.

U.S. Pat. No. 4,875,948 discloses a combustible delay barrier that is intended to ignite upon intrusion, thereby delaying unauthorized entry until the arrival of authorities. The delay barrier includes a combustible layer having an oxidizer, a fuel metal, and a binder which also serves as a source of fuel.

U.S. Pat. No. 6,843,868 discloses a rocket propellant and explosive made from metal nanoparticles and fluoro-organo chemical compounds or fluoropolymers as microbeads, nanoparticles, or powder.

US 2007/0272112 discloses a reactive material for use in shot shells. The reactive material includes at least one binder, at least one fuel, and at least one oxidizer. The fuel and oxidizer may form a thermitic composition, having a metal and a metal oxide that react exothermically.

US 2010/0193093 discloses a process for preparing composite thermite particles. Within this process, a reducing metal and a complementary metal oxide are milled at a temperature of less than 50° C. The milling is performed within a ball mill. The temperature is lowered using liquid nitrogen or other liquefied gas. The result is repeated fracturing and stolid state welding of the metal and metal oxide, thereby forming layers of metal oxide and metal having an average thickness of between 10 nm and 1 μm. The resulting particles are less than 100 μm in size, and generally less than 10μ. These particles may be pressed together to form consolidated objects having dimensions of a few millimeters up to tens of centimeters. Pressing can be performed either at room temperature or at lower temperature. A fluidic binder may be added before or after pressing.

None of the above references disclose an energetic or thermite material wherein the reducing metal and metal oxide are deposited in layers, and then simply utilized in that layered configuration to produce an explosive shock. Furthermore, none of the above references discloses the use of multiple, individually controlled ignition points. Accordingly, there is a need for an energetic or thermite material having a layered structure and multiple ignition points. There is a further need for an ignition system providing individual control of multiple ignition points. This structure not only facilitates manufacture of an energetic or thermite material for numerous applications, but also facilitates other advantages such as charge and blast shaping, ignition timing, pressure curve control and maximization, safe neutralization of the energetic material, and other advantages that are more fully explained below.

SUMMARY

The above needs are met by a combination of an energetic material and an ignition system. The combination has a plurality of energetic layers, including at least a first layer comprising a metal oxide or a first reaction pair component, and a second layer comprising a reducing metal or a second reaction pair component. The combination further includes a gas producing layer. The gas producing layer is disposed in sufficiently close proximity to the energetic layers so that ignition of the plurality of energetic layers will vaporize the gas producing layer. The combination is of unitary construction with the ignition system forming a layer of the combination. The ignition system has a plurality of ignition signal conductors therewithin. The ignition system further has an ignition point corresponding to each ignition signal conductor. The ignition system is structured to provide an ignition signal to each ignition point at a predetermined time and with a predetermined sequence with respect to ignition signals provided to other ignition points.

These and other aspects of the invention will become more apparent through the following description and drawings.

BRIEF DESCRIPTION OF THE DRAWINGS

Like reference characters denote like elements throughout the drawings.

DETAILED DESCRIPTION

Figure 1:
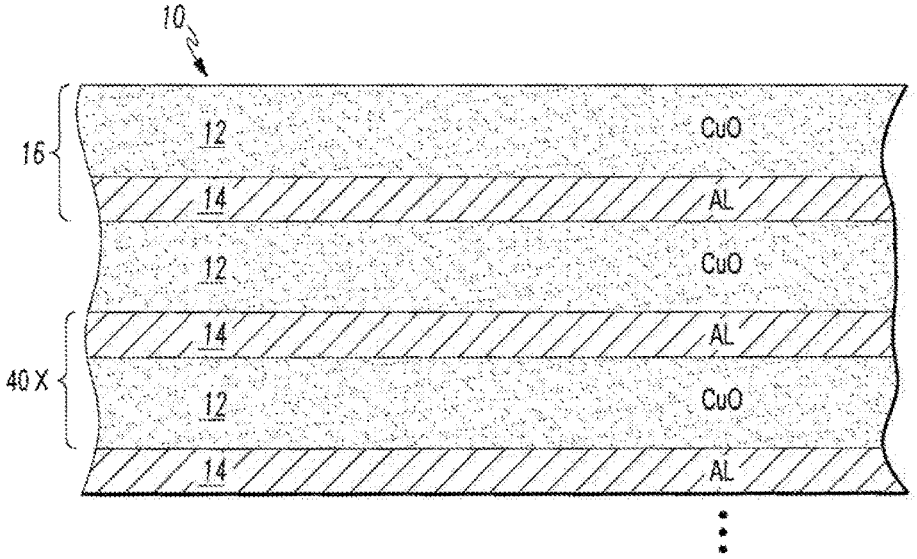
FIG. 1 is a schematic diagram showing a layered structure of an energetic material.

Referring to FIG. 1, an energetic material 10 having a sheet structure with at least one layer of metal oxide 12 and at least one adjacent layer of a reducing metal 14 is provided. In some examples of the metal oxide 12 include $La_2O_3$, AgO, $ThO_2$, SrO, $ZrO_2$, $UO_2$, BaO, $CeO_2$, $B_2O_3$, $SiO_2$, $V_2O_5$, $Ta_2O_5$, NiO, $Ni_2O_3$, $Cr_2O_3$, $MoO_3$, $P_2O_5$, $SnO_2$, $WO_2$, $WO_3$, $Fe_3O_4$, CoO, $CO_3O_4$, $Sb_2O_3$, PbO, $Fe_2O_3$, $Bi_2O_3$, $MnO_2$, $Cu_2O$, and CuO. Some examples of the reducing metal 14 include Al, Zr, Th, Ca, Mg, U, B, Ce, Be, Ti, Ta, Hf, and La. The illustrated example utilizes CuO as the metal oxide 12, and Al as the reducing metal 14. Another example utilizes $Fe_2O_3$ as the metal oxide 12, and Al as the reducing metal 14.

Many examples of the energetic material 10 include a plurality of alternating layers of metal oxide 12 and reducing metal 14. As few as one composite metal oxide/reducing metal layer 16 may be utilized. Alternatively, as many composite layers 16 as a size and manufacturing efficiency permit may be utilized. The illustrated example of FIG. 1 includes 40 composite layers 16.

The thickness of the metal oxide layer 12 and reducing metal layer 14 are determined to ensure that the proportions of metal oxide and reducing metal are such so that both will be substantially consumed by the exothermic reaction. As one example, in the case of a metal oxide layer 12 made from CuO and reducing metal layer 14 made from Al, the chemical reaction is $3CuO+2Al \rightarrow 3Cu+Al_2O_3+heat$. The reaction therefore requires 3 moles of CuO, weighing 79.5454 grams/mole, for every 2 moles of Al, weighing 26.98154 grams/mole. CuO has a density of 6.315 g/cm$^3$, and aluminum has a density of 2.70 g/cm$^3$. Therefore, the volume of CuO required for every 3 moles is 37.788 cm$^3$. Similarly, the volume of Al required for every 2 moles is 19.986 cm$^3$. Therefore, within the illustrated example of a composite layer 16, the metal oxide 12 is about twice as thick as the reducing metal 14. If other metal oxides and reducing metals are selected, then the relative thickness of the metal oxide 12 and reducing metal 14 can be similarly determined.

The thickness and number of layers 12, 14 is selected to balance contact between the metal oxide 12 and reducing metal 14 (which would be accomplished by thinner layers), while maintaining manufacturing efficiency (which may in some instances be accomplished by thicker layers). The desired reaction rate also affects the thickness of the layers, with faster reaction rates resulting from thinner layers, and slower reaction rates resulting from thicker layers. Some examples of individual layer thicknesses may range from about 5 nm (for the thinner of the two types of layers) to about 1000 nm thick. One example of a composite layer 16 includes a metal oxide that is about 54 nm thick, and a reducing metal that is about 26 nm thick.

Figure 2:
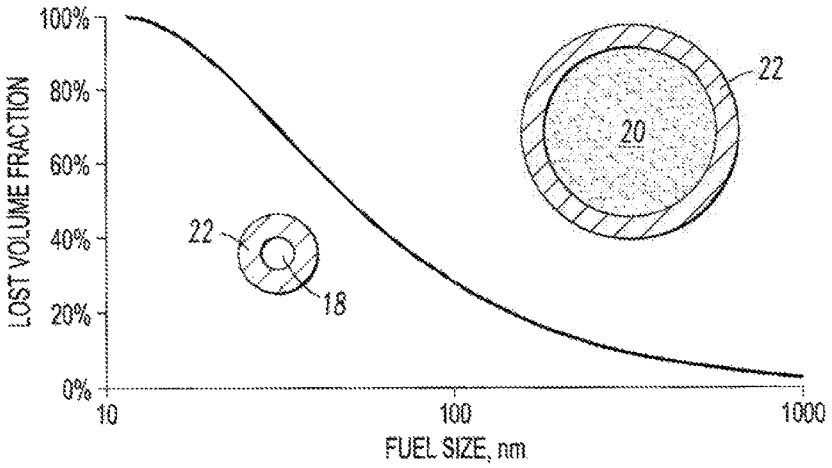
FIG. 2 is a graph showing the relationship between fuel size and volume lost due to surface oxidation for spherical shaped fuel.
Figure 3:
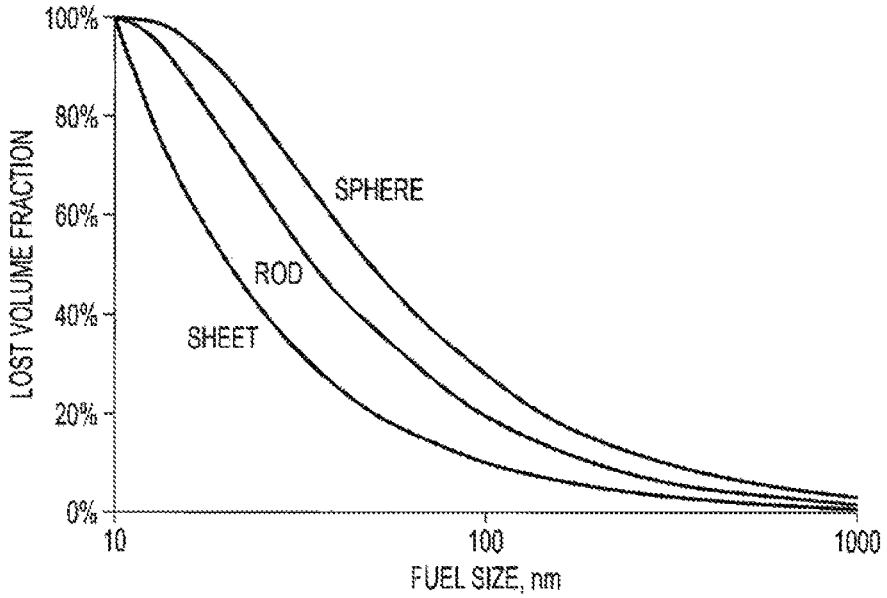
FIG. 3 is a graph showing the relationship between fuel size and volume lost due to surface oxidation, comparing a sphere, rod, and sheet.

The sheet or layered structure of the energetic material 10 includes significant advantages over prior energetic material structures. FIG. 2 illustrates a powdered form of thermite fuel. A smaller fuel particle size 18 provides greater surface contact between the metal oxide and reducing metal than a larger fuel particle 20. However, if Al is used as the reducing metal, then $Al_2O_3$ 22 can form on the surface. A typical oxide 22 thickness on the surface of the Al is about 5 nm. As shown in FIG. 2, the proportion of oxide to reducing metal is greater with smaller particle sizes. Other fuel configurations are compared in FIG. 3, which shows that the lost volume fraction due to oxide is lower with fuel in a rod form, and even lower with fuel in the form of a sheet, although in each case, smaller fuel sizes result in greater loss.

Figure 4:
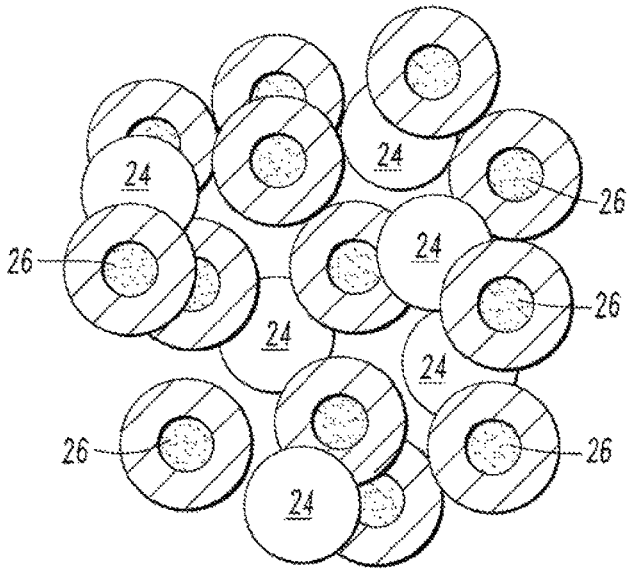
FIG. 4 is a diagram showing surface contact between metal oxide particles and reducing metal particles for spherical shaped fuel.
Figure 5:
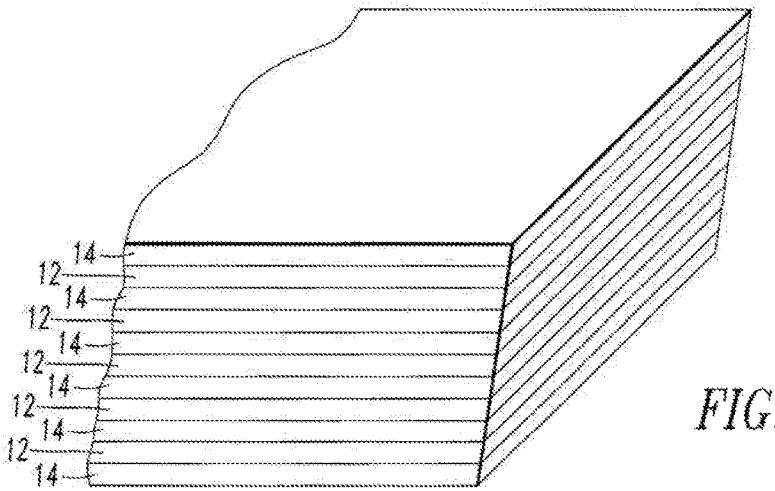
FIG. 5 is a diagram showing surface contact between metal oxide layers and reducing metal layers for a layered sheet fuel structure.

Referring to FIGS. 4-5, another advantage of the energetic material 10 is illustrated. A typical particle or powder fuel configuration, as illustrated in FIG. 4, has about 5% surface contact between the metal oxide 24 and reducing metal 26. By comparison, the sheet or layered structure of FIG. 5 provides close to 100% surface contact between the metal oxide 12 and reducing metal 14, speeding the reaction between the metal oxide 12 and reducing metal 14. Additionally, the high percentage of surface contact between the metal oxide 12 and reducing metal 14 reduces the formation of $Al_2O_3$ between the metal oxide and reducing metal, thereby combining the reaction advantages of small fuel size with the fuel volume advantages of large fuel size. The layered structure 10 can be made in a manner that resists the formation of oxides during deposition, as described in greater detail below.

One method of making an energetic material 10 is by sputtering. Another method is physical vapor deposition. Specific manufacturing methods described in U.S. Pat. No. 8,298,358, issued to Keven R. Coffey on Oct. 30, 2012, and U.S. Pat. No. 8,465,608, issued to Kevin R. Coffey on Jun. 18, 2013, are suited to depositing the alternating metal oxide and reducing metal layers in a manner that resists the formation of oxides between the alternating layers, and the entire disclosure of both patents is expressly incorporated herein by reference. Yet another method of making the energetic material 10 is by three dimensional printing, which is expected to provide a very simple manufacturing process. Ignition points, conductors, and reactive lands within the energetic material 10, as described in greater detail below, can be created using any of these methods through lithography and deposition of the appropriate ignition structures after deposition of a layer in which a portion of an ignition point will be located. Creating these structures can be accomplished in the same manner as the creation of integrated circuits.

The energetic material 10 may be formed into various configurations depending on the blast timing and configuration desired, as well as the use to which the energetic material 10 is intended. The alternating layers 12 and 14 may be deposited in the form of flat sheets. Alternatively, the layers may be deposited in the form of concentric, nested cylinders. As another alternative, a flat sheet consisting of one or more composite layers 16 may be rolled into a generally cylindrical shape. A cylindrical shape may be useful for placing the energetic material 10 within a pressure vessel, for example, a missile fuel chamber or a firearm cartridge casing.

Figure 6:
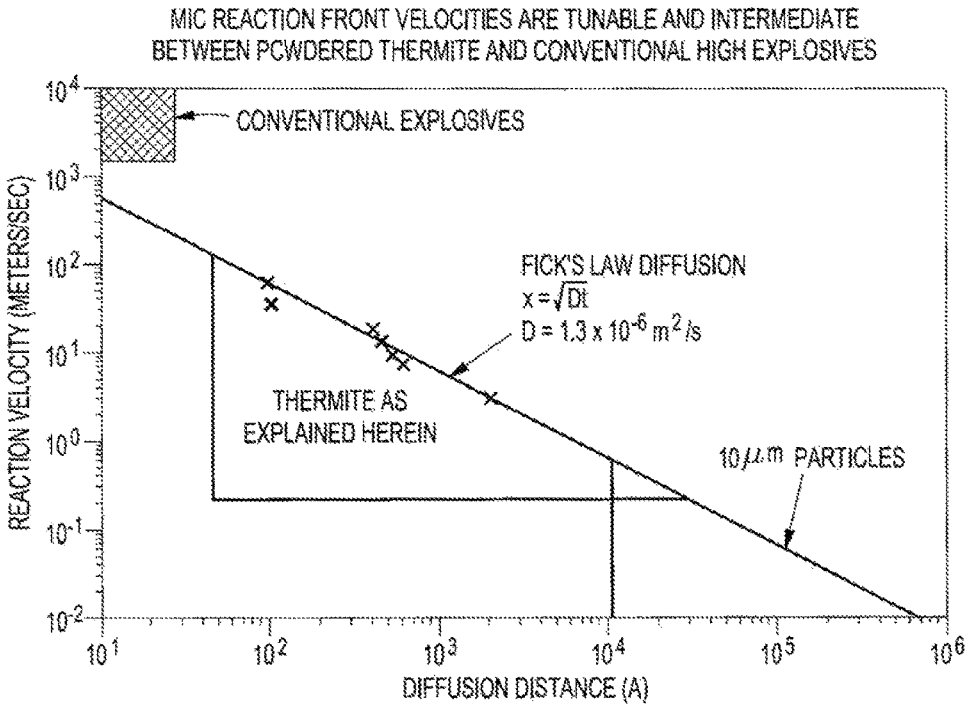
FIG. 6 is a graph showing the reaction velocity verses diffusion distance, comparing conventional high explosives, conventional powdered thermites, and an energetic material of FIG. 1.

Referring to FIG. 6, one advantage of an energetic material 10 is illustrated. As shown in this graph, conventional explosives have a very high reaction velocity and load diffusion distance. Conversely, conventional powdered thermite has a very low reaction velocity, and high diffusion distance. An energetic material 10 has a reaction velocity and diffusion distance between that of conventional explosives and powdered thermites. Furthermore, the reaction velocity and diffusion distance of an energetic material 10 are tunable by selecting the specific composition, as well as number and thickness of layers of metal oxide 12 and reducing metal 14, of the energetic material 10.

Figure 7:
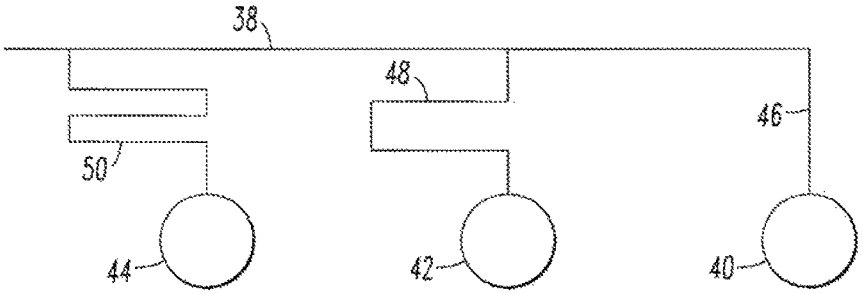
FIG. 7 is an example of utilizing different length fuses to control the timing of ignition at various ignition points.

An ignition system 28 for an energetic material 10 may include multiple ignition points, as well as a method of controlling the timing and/or sequence of activation of individual ignition points. FIG. 7 illustrates one method of controlling ignition timing. In the example of FIG. 7, a burnable fuse 38 is used to ignite the energetic material 10. Three reactive lands 40, 42, 44 are illustrated. The length of fuse portions 46, 48, 50 determines the time required for the fuse to burn, and therefore the timing and sequence of activation of the reactive lands 40, 42, 44. The fuse portions 46, 48, 50 are insulated from direct contact with the energetic material 10 except at the reactive lands 40, 42, 44, so that the burning of fuses 46, 48, 50 does not ignite the energetic material 10 until the flame within each fuse reaches the reactive lands 40, 42, 44.

Figure 8A:
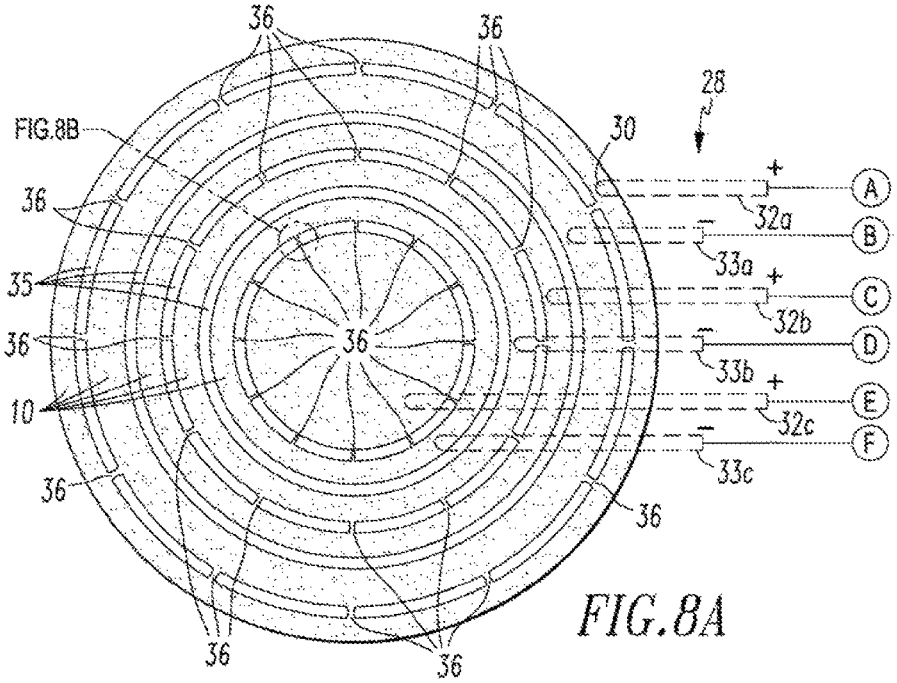
FIG. 8A is a schematic diagram of a structure and ignition system for an energetic material of FIG. 1.
Figure 8B:
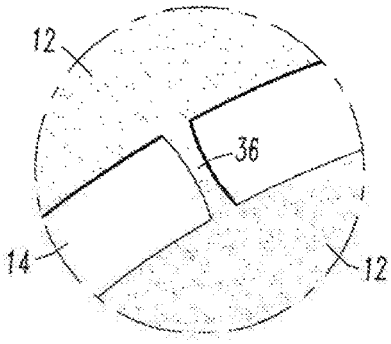
FIG. 8B is a cutaway diagram of a narrow, resistance inducing section of metal oxide forming a portion of an ignition point of FIG. 8A.

Referring to FIGS. 8A-B, another example of a patterned deposition of energetic material 10 is illustrated, along with an example of multiple ignition points. FIG. 8A illustrates concentric circles of energetic material 10, separated by gaps 35 which may in some examples include insulating material. A pair of reactive lands consisting of a positive electrode 32 and a negative electrode 33 (referred to as a group using the number alone, and as specific pairs by the number followed by a, b, or c) are disposed within alternating layers of energetic material 10, separated by a gap 35. The gaps 35 within which an ignition point is desired include narrow bands 36 of energetic material forming high resistance points at which current passing between the positive electrode 32 and negative electrode 34 will create sufficient heat to ignite the energetic material 10. These bands can be formed, for example, by a pair of triangles projecting from the energetic material 10 into the gap 35, with the tips of the triangles touching at the approximate center of the gap 35. The number and location of ignition points selected depends on the structure, number of alternating layers 10, 35, and intended purpose of the patterned deposition. The example illustrated in FIG. 8A includes five layers 35, three of which include the narrow bands 36 disposed at various locations around the layer 35. In general, a greater number of bands 36 will be utilized within layers 35 that are located closer to the exterior of the generally cylindrical energetic material 10 than for layers 35 disposed closer to the center of the cylinder, due to the larger circumference of layers located closer to the exterior. When a voltage is applied to a pair of positive leads 32 and negative leads 33, all of the bands 36 disposed in the layer 35 between the layers in which the positive leads 32 and negative leads 33 are disposed will be energized. The use of an electrical charge as an ignition mechanism provides for a wide range of means for controlling the timing and/or sequence of ignition. In FIG. 8A, the letters A, B, C, D, E, and F associated with each connection for a positive or negative contact may be associated with the appropriate contacts of various electrical control systems as described below and shown in FIGS. 9-10.

Figure 9:
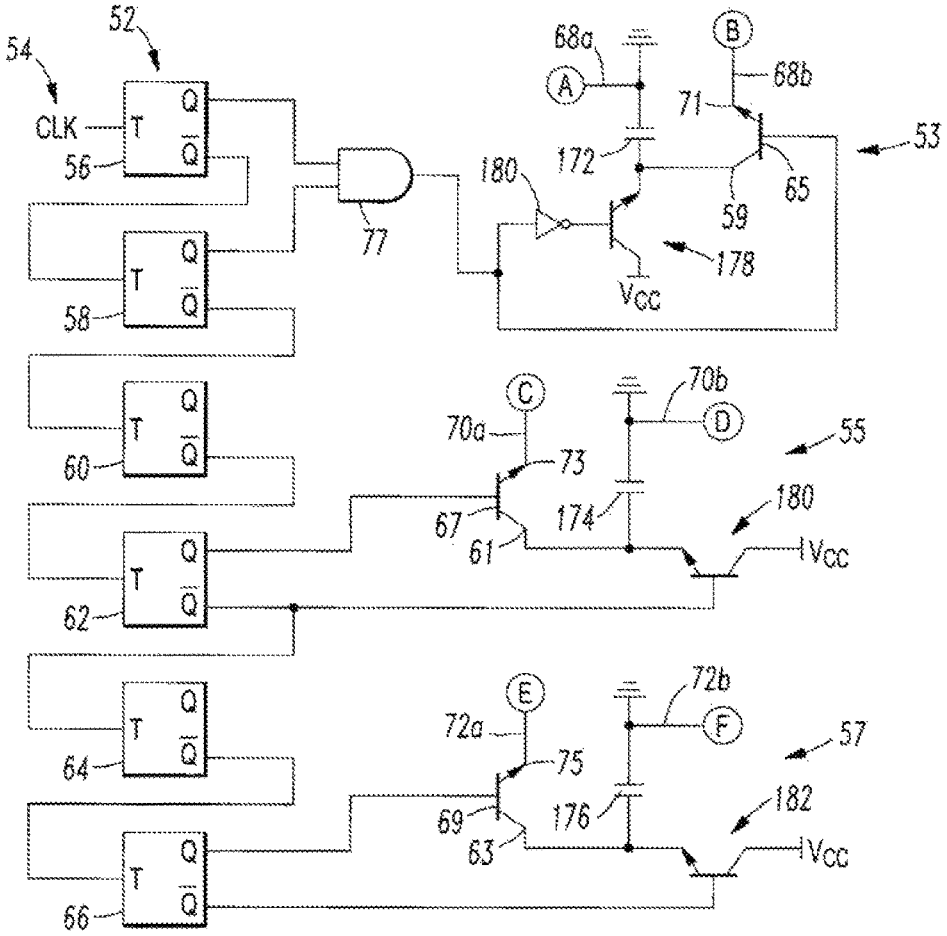
FIG. 9 is an example of utilizing a counting circuit to control the timing of ignition at various ignition points.

FIG. 9 illustrates another method of controlling ignition timing, in this example utilizing electrical ignition as illustrated in FIGS. 8A-B. A counting circuit 52 is utilized to control the timing and sequence of ignition. Although any counting circuit could be used, the illustrated example of a counting circuit includes a plurality of T flip-flops, with the T flip-flop closest to the clock 54 representing the lowest bit, and the T flip-flop farthest from the clock 54 representing the highest bit. In the illustrated example, six T flip-flops 56, 58, 60, 62, 64, 66 are illustrated, with flip-flop 56 representing the lowest bit, and flip-flop 66 representing the highest bit. The clock is connected to the input of flip-flop 56. The inverted output of flip-flop 56 is connected to the input of flip-flop 58. Similarly, the inverted output of flip-flop 58 is connected to the input of flip-flop 60. The pattern continues for all of the flip-flops 56-66. The output of a T flip-flop inverts with every "1" input. Therefore, flip-flop 56 will change between the on and off state with every clock cycle. Similarly, flip-flop 58 will change between the on and off state with every second clock cycle. Flip-flop 60 will change between the on and off state every fourth clock cycle. Flip-flop 62 will change every eighth clock cycle flip-flop 64 will change every 16th clock cycle. Flip-flop 66 will change every 32nd clock cycle. Ignition at intermediate clock cycles can be achieved by connecting the output of the appropriate flip-flops through logical gates. Therefore, ignition point 68 (formed by contacts 68*a* and 68*b*), which is activated by the output of flip-flops 56 and 58 through the "and" gate 77, will ignite on the third clock cycle. Ignition point 70 (formed by contacts 70*a* and 70*b*), which is activated by the output of flip-flop 62, will be activated on the eighth clock cycle. Ignition point 72 (formed by contacts 72*a* and 72*b*), which is activated by the output of flip-flop 66, will be activated on the 32nd clock cycle. The timing and sequence of ignition can therefore be determined by selecting an appropriate number of T flip-flops, clock cycle, and ignition point location within the array of T flip-flops.

In order to enhance the reliability of ignition, the signal from the T-flip-flops 56-66 are not directly used to ignite the energetic material 10. Instead, the signal is utilized to control a larger ignition current through a transistor or combination of transistors, as well as the optional use of capacitors to store the charge that will be used for ignition. Although single NPN transistors 53, 55, 57 are illustrated, alternative arrangements could utilize PNP transistors, or combinations of transistors such as Darlington pairs or other known amplification structures, depending on the amplification desired to provide adequate current to the ignition points. In the illustrated example, transistors 53, 55, 57 are associated with the ignition points 68, 70, and 72, respectively. Each ignition point 68, 70, 72 is connected to the emitter 71, 73, 75 of the appropriate transistor 53, 55, 57, respectively, with the ignition point also being connected to one terminal of a capacitor 172, 174, 176 at the opposite end of the gap forming the ignition point. The opposite end of the capacitor 172, 174, 176 is connected to the emitter 59, 61, 63 of the appropriate transistor 53, 55, 57. The signal from the "and" gate 77 as well as each T flip-flop 62, 66 is connected to the base 65, 67, 69 of the appropriate transistor 53, 55, 57, respectively. A power supply is connected to each capacitor 172, 174, 176 through a second transistor 178, 180, 182, which is connected to the inverted triggering signal for each ignition point 68, 70, 72. In the case of ignition point 68, the output of the "and" gate 77 is directed to an inverter 180 and then to the base of transistor 178. In the case of ignition points 70, 72, the inverted output of the flip flops 62, 66 is provided to the base of transistors 180, 182, respectively. Thus, any time no ignition signal is present, transistors 178, 180, 182, supply voltage from the power supply to charge the capacitors 172, 174, 176, and the transistors 53, 55, 57 do not conduct current. An ignition signal cuts off voltage through transistors 178, 180, 182, and permits current to flow through transistors 53, 55, 57, discharging the capacitors 172, 174, 176 through the ignition points 68, 70, 72.

When the counting circuit 52 sends an ignition signal through T flip flop 56, current is able to flow through transistor 53, thereby activating ignition point 68. Current thereby passes through the contacts A, B to the leads 32*a*, 33*a* in FIG. 8A. Similarly, when the counting circuit 52 sends an ignition signal through T flip-flop 62, current may flow through transistor 55, thereby activating ignition point 70. Current thereby passes through the contacts C, D to the leads 32*b*, 33*b* in FIG. 8A. An ignition signal at T flip-flop 66 similarly enables current flow through transistor 57, thereby activating ignition point 72. Current thereby passes through the contacts E, F to the leads 32*c*, 33*c* in FIG. 8A.

Figure 10:
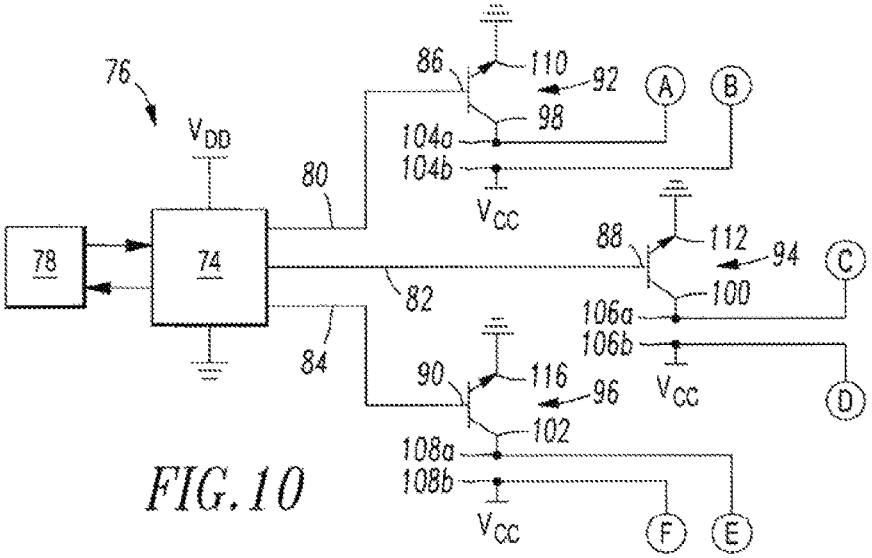
FIG. 10 is a schematic diagram showing a microprocessor circuit for controlling ignition timing and sequence.

As another alternative, illustrated in FIG. 10, ignition timing and sequence may be controlled by a microcontroller 74, which in some examples may be user programmable. A variety of controllers could be selected, including general-purpose programmable microcontrollers, programmable logic devices such as field programmable gate arrays, application specific integrated circuits, and custom integrated circuits. In the illustrated example, the microcontroller 74 is provided with a power supply 76 (which could take any conventional form) and user interface 78. The user interface 78 may be a standard USB port or other wire connection to a computer or other programming device. Alternatively, the user interface 78 may be a wireless device such as Bluetooth. Output pins 80, 82, 84 are connected to the bases 86, 88, 90 of transistors 92, 94, and 96, respectively. Although single NPN transistors 92, 94, 96 are illustrated, alternative arrangements could utilize PNP transistors, or combinations of transistors such as Darlington pairs or other known amplification structures, depending on the triggering configuration of the selected microprocessor as well as the amplification desired to provide adequate current to the ignition points. The base 98, 100, 102 of the transmitters 92, 94, 96, respectively, are connected to ignition points 104, 106, 108, respectively. The ignition points 104, 106, 108 are each also connected to a power supply. The emitters 110, 112, 116 of the transistors 92, 94, 96, respectively are each connected to ground.

When the microcontroller 74 sends an ignition signal through output pin 80, current is able to flow through transistor 92, thereby activating ignition point 104. Current thereby passes through the contacts A, B to the leads 32*a*, 33*a* in FIG. 8A. Similarly, when the microcontroller 74 sends an ignition signal through output pin 82, current may flow through transistor 94, thereby activating ignition point 106. Current thereby passes through the contacts C, D to the leads 32*b*, 33*b* in FIG. 8A. An ignition signal at output pin 84 similarly enables current flow through transistor 96, thereby activating ignition point 108. Current thereby passes through the contacts E, F to the leads 32*c*, 33*c* in FIG. 8A. The timing and sequence of ignition can be varied as desired simply by providing the appropriate program to the microcontroller 74.

Although the example of FIG. 9, but not FIG. 10, includes the use of capacitors as the immediate voltage sources for the ignition points, the capacitor system shown in FIG. 9 could just as easily be utilized with the microcontroller 74 of FIG. 10. Similarly, use of another voltage supply as shown in FIG. 10 could just as easily be done with the counting circuit of FIG. 9.

Figure 11:
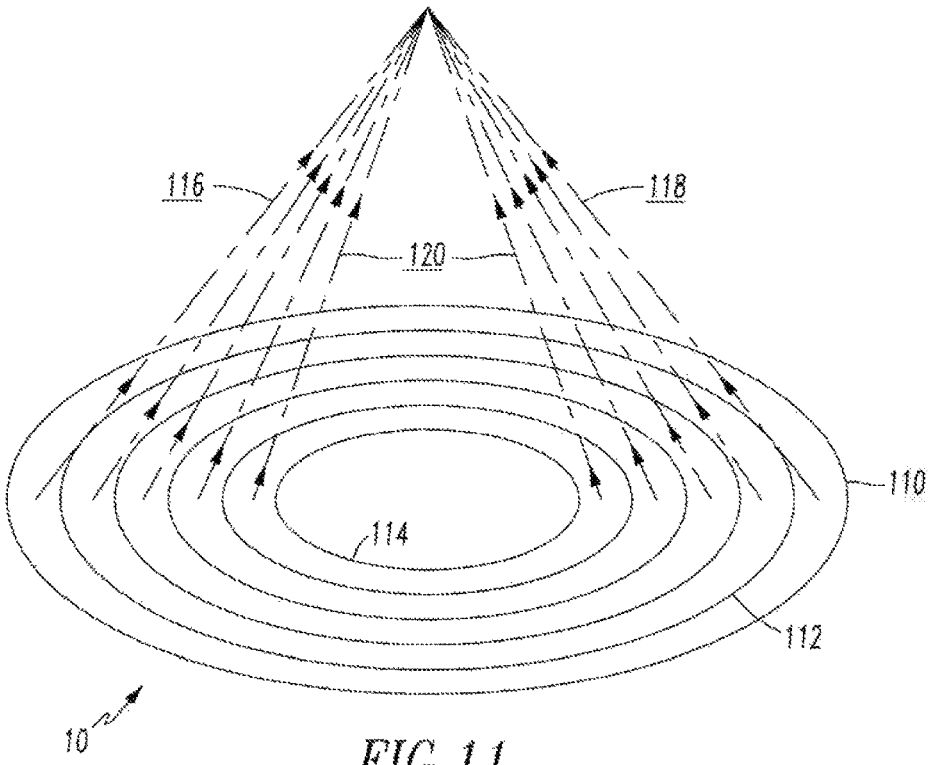
FIG. 11 is a schematic diagram of the converging pressure waves produced by the concentric circular charge pattern of FIG. 8A.

One example of how ignition timing and sequencing can be utilized is illustrated in FIG. 11. The energetic material 10 depicted in FIG. 11 is a cylinder, utilizing the structure of FIG. 8A. In the example of FIG. 11, the outermost layers 110 are ignited first, followed by the next outermost layers 112. The innermost layers 114 are ignited last. If, for example, focusing the shock wave from the blast at a point that is aligned with the center of the cylinder is desired, then the timing of ignition can be determined accordingly. The pressure wave 116, 118 from the outermost layers 110 would travel farther in order to reach the point of interest than the pressure wave 120 from the central portion of the cylinder. Therefore, in order for the entire pressure wave to arrive simultaneously, the timing of the ignition of the outermost layers 110, layers 112, any additional layers, and innermost layers 114 will take into account the distance that must be traveled by the pressure wave as well as the time required to travel that distance, so that all pressure waves arrive at essentially the same time. The resulting pressure and energy density will thereby be much higher than that emanating from each charge ring. On a small scale, such a patterned, time sequenced device can be used as detonator against an explosive charge. As another alternative, the timing of the ignition of the outer layers 110, 112 with respect to the inner layers 114 and any other layers that may be present can be utilized so that the slightly earlier pressure wave from the outer layers 110 focuses and channels the pressure wave from the inner layers along a narrower path, again resulting in higher energy density.

Figure 18:
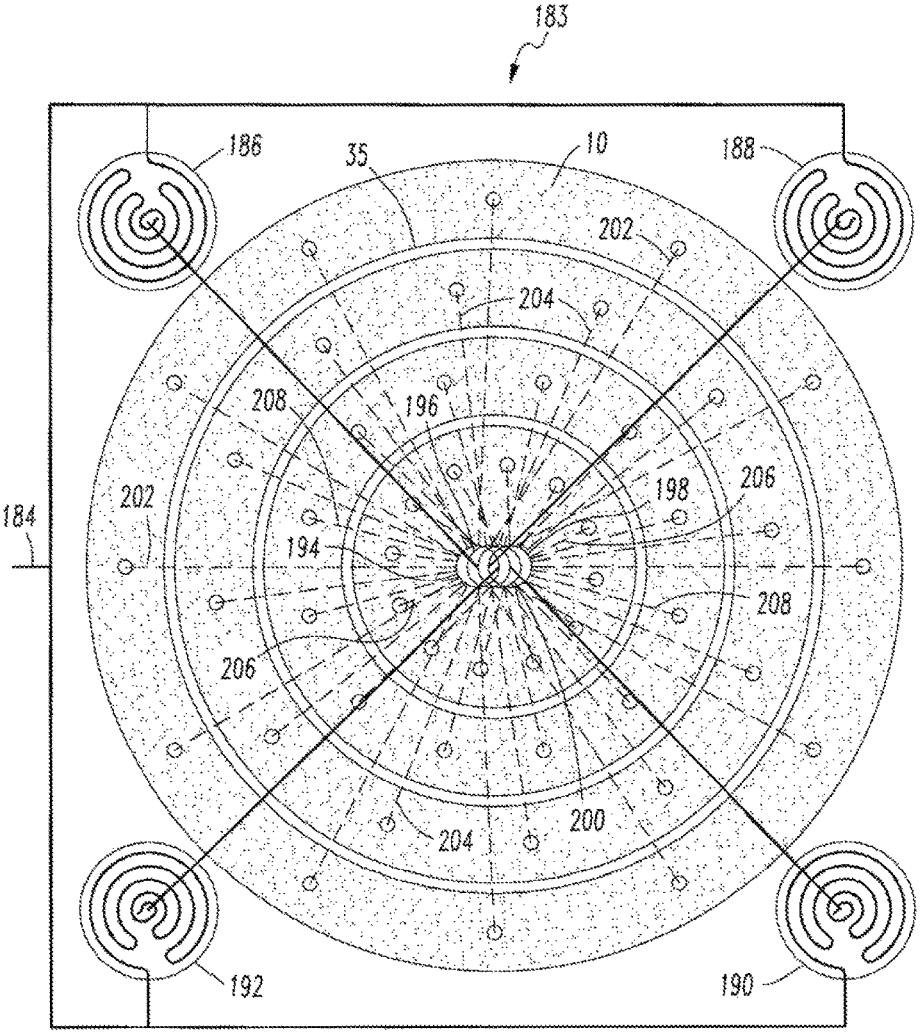
FIG. 18 is a schematic diagram of another structure and ignition system for an energetic material of FIG. 1.

Referring to FIG. 18, an energetic structure 183 in the form of concentric generally cylindrical layers is illustrated. The energetic material of FIG. 18 utilizes concentric circles of energetic material 10 separated by gaps 35, in a manner similar to that of FIG. 8A. The electrical ignition system of FIG. 8A is replaced by a timing fuse ignition system that works on the same principle as shown in FIG. 7. In the illustrated example, a single fuse 184 is used to initiate ignition. The fuse 184 is connected to a plurality of timing delay fuses 186, 188, 190, 192. Each of the timing delay fuses 186, 188, 190, 192 has a length that is proportional to the desired delay (or lack of delay) that is desired for the particular layer of energetic material 10 to which it is operatively connected. Each of the delay fuses 186, 188, 190, 192 leads to a hub 194, 196, 198, 200, respectively, that is generally centrally located with respect to the cylindrical structure 183. Each central hub 194, 196, 198, 200 includes a plurality of spokes 202, 204, 206, 208, respectively, with the spokes 202, 204, 206, 208 all terminating at ignition points disposed within the layer of energetic material 10 that is to be ignited by the operatively connected delay fuse 186, 188, 190, 192. Thus, the timing of ignition for outer layer of energetic material 10 is controlled by the length of the delay fuse 186. Similarly, the timing of the next outer layer of material is controlled by the length of the delay fuse 188. The ignition timing of the next innermost layer is controlled by the length of the delay fuse 192. Lastly, the ignition timing of the innermost layer is controlled by the length of the delay fuse 190.

The same blast timing and shaping effects can thus be obtained from a generally cylindrical structure using either an electrically controlled ignition system or a delay fuse controlled ignition system. Whether an electrical system or a delay fuse system is utilized will depend on the specific application, as well as the peripheral systems with which the energetic material will be utilized. For example, if ignition is initiated by an ignitable primer, then a delay fuse may be preferable. If ignition is initiated by an electrical or computer control system, then an electrical ignition system may be preferred.

Figure 12:
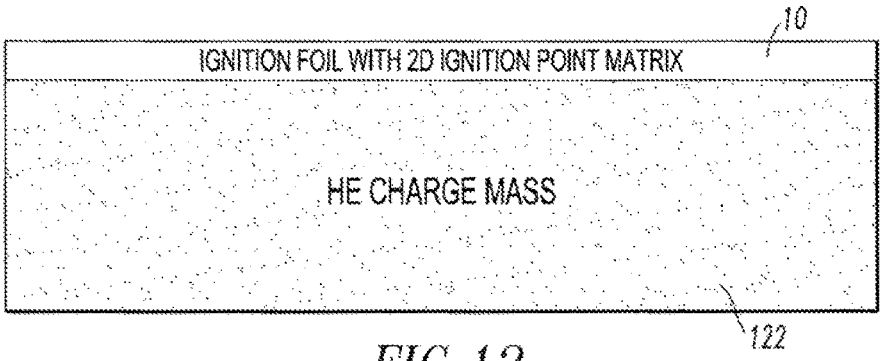
FIG. 12 is an example of a combination of an energetic material with a high explosive.
Figure 13:
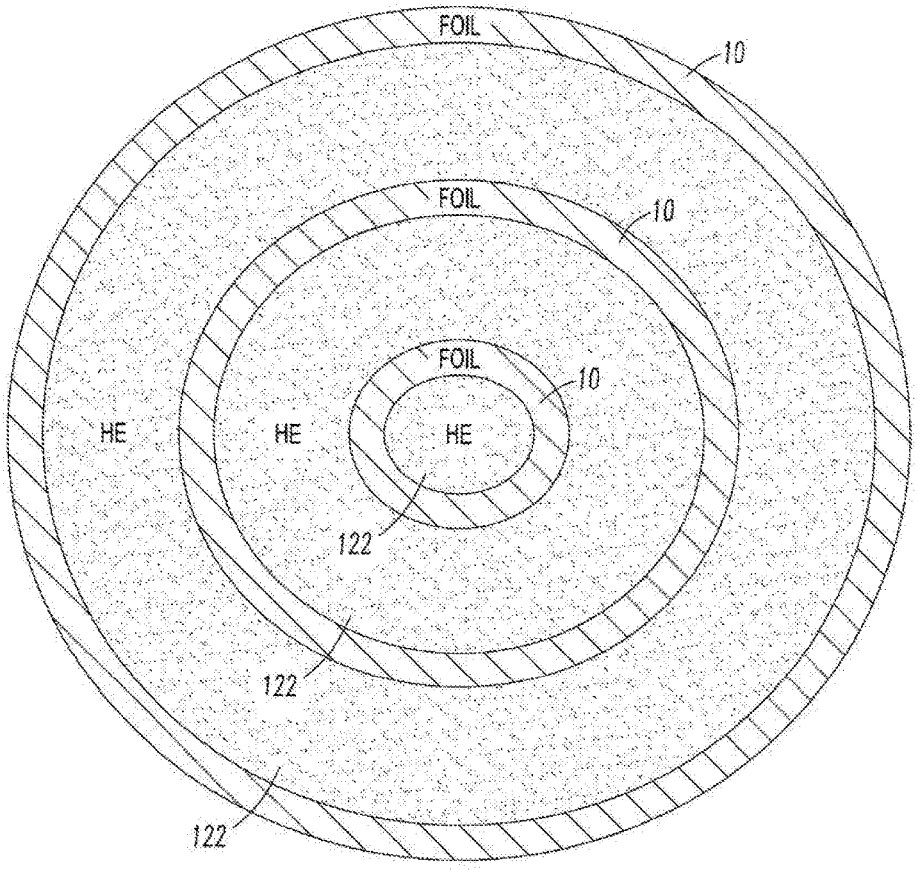
FIG. 13 is another example of a combination of an energetic material with a high explosive.

Referring to FIGS. 12-13, an energetic material 10 may be combined with a conventional high explosive 122 by providing one or more layers of the energetic material 10 on or within the high explosive 122. The combination of the energetic material 10 with a high explosive not only increases the blast power, but can also provide blast directionality, particularly in the configuration of FIG. 13. In the same manner as shown in FIG. 7, outer layers of energetic material 10 can be ignited before inner layers of energetic material 10, with the ignition of the energetic material also detonating adjacent high explosive material. As before, the timing of the ignition can be predetermined so that the pressure wave from all rings reaches a given point at the same time, maximizing the energy density applied at that point. For a point located along the central axis of the cylinder, the pressure wave from the outer cylinders travels farther, so these rings are ignited earlier to account for the additional time needed for the pressure wave to travel the additional distance.

Figure 14A:
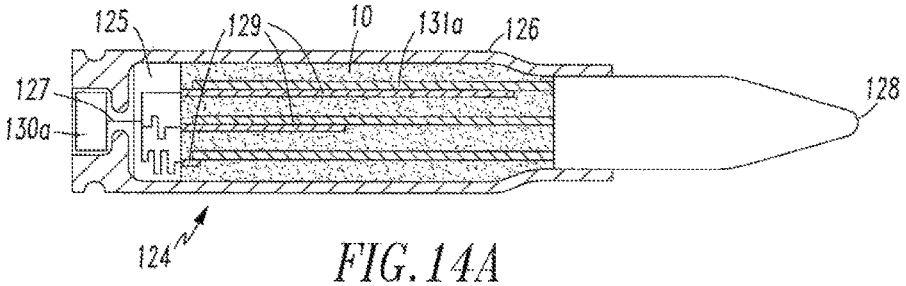
FIG. 14A is a cutaway side elevational view of a firearm cartridge containing a standard primer and an energetic material of FIG. 8.
Figure 14B:
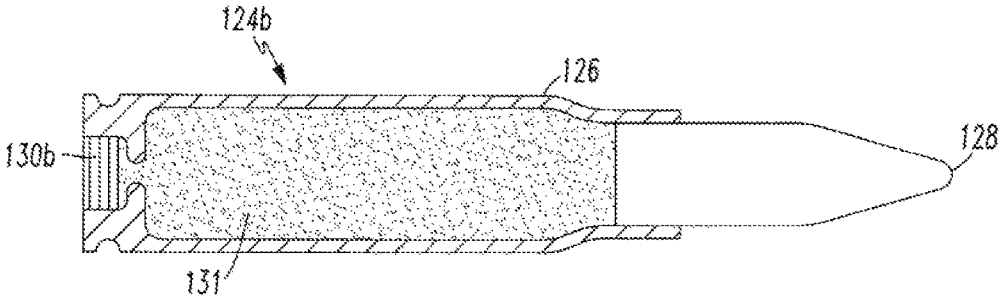
FIG. 14B is a cutaway side elevational view of a firearm cartridge containing a standard smokeless powder and a primer made from an energetic material of FIG. 8.

FIGS. 14A-16 illustrate another advantage of the energetic material 10. If the energetic material 10 is placed inside a pressure vessel, the timing and sequence of ignition can be controlled to maximize the area under the pressure curve while maintaining a maximum pressure below the maximum safe pressure of the pressure vessel. A pressure vessel could include the casing of a firearm cartridge, the fuel chamber of a missile, the warhead of a missile (in which case the pressure vessel is obviously intended to be ruptured), etc. In the illustrated example of FIGS. 14A-C, a firearm cartridge 124*a-c* includes a casing 126 securing a bullet 128 at its forward end. The example of FIG. 14A shows a conventional primer 130*a* at its rear end and a propellant 131*a* made from an energetic material 10. The example of FIG. 14B shows a primer 130*b* that is made from the energetic material 10 and a propellant 131*b* consisting of conventional smokeless powder. FIG. 14C illustrates the use of an energetic material 10 for both the primer 130*b* and the propellant 131*b*.

The primers 130*b* are made from sufficiently thin layers of metal oxide 12 and reducing metal 14 so that a strike from a firing pin will be sufficient to ignite the energetic material 10 forming the primers 130*b*. Depositing individual layers of the energetic material 10 under elevated and/or reduced temperatures can be used to create expansion/contraction stresses with respect to other layers within the material as these layers return to room temperature, thereby enhancing the sensitivity of primers 130*b* to firing pin strikes. To form the propellant 130*b*, the energetic material 10 can be placed inside the casing 126 by rolling a sheet of layered energetic material 10 and then inserting the roll into the casing 126. Alternatively, the energetic material 10 may be placed inside the casing 126 by pressing layers of energetic material into the casing 126.

Figure 14C:
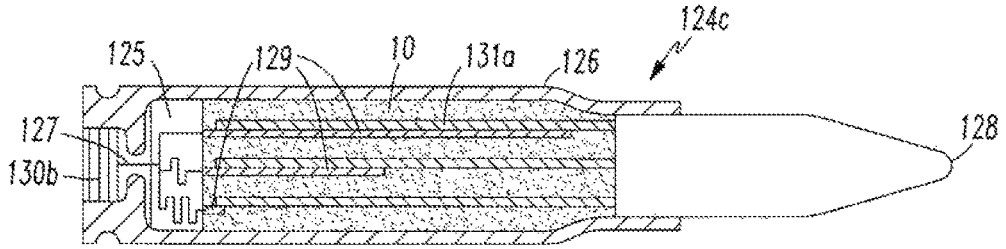
FIG. 14C is a cutaway side elevational view of a firearm cartridge containing a propellant and primer made from an energetic material of FIG. 8.

In the examples of FIGS. 14A and 14C, a meandering fuse structure 125, of the type shown in FIG. 7, provides an operative connection between the primer 130 and energetic material 10, while also isolating the energetic material 10 from the primer 126, so that a primer strike does not directly ignite the energetic material 10. The fuse structure 125 includes an initiator end 127 operatively connected to the primer 126, and one or more terminating ends 129 operatively connected to different locations and/or layers within the energetic material 10. Striking a primer 130*a* or 130*b* will ignite the fuse structure 125, which will ignite the energetic material 10 according to the timing built into the fuse structure 125. If the casing 126 contains traditional smokeless gunpowder 131*b* (FIG. 14B), the pressure curve would resemble that of FIG. 15, rapidly rising to the maximum pressure, and then quickly tapering off while the bullet is still within the barrel of the firearm, and capable of receiving additional energy from the burning gases. The timing of ignition for an energetic material 10 as shown in FIGS. 14A and 14C can be structured to provide a pressure curve of FIG. 16, rapidly taking the pressure level to a maximum pressure level below the safe maximum pressure level of the casing 126, and maintaining this pressure level throughout the entire time that the bullet is within the barrel, thereby transferring the maximum possible velocity and energy to the bullet.

Figure 17:
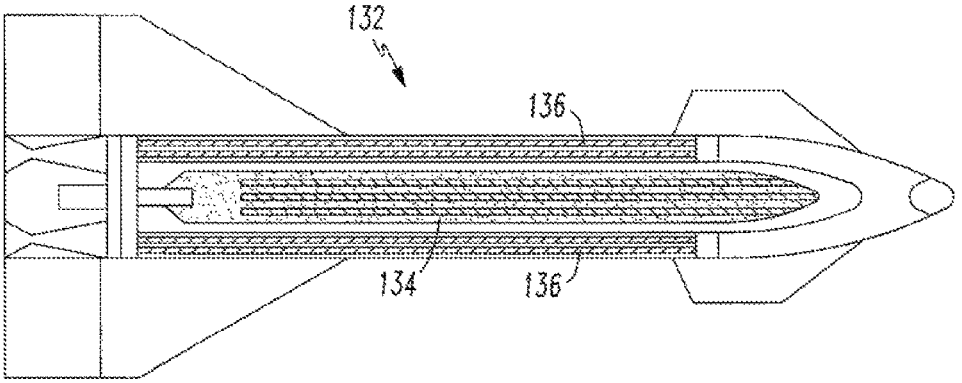
FIG. 17 is a cutaway side elevational view of a missile utilizing the energetic material of FIG. 1.
Figure 15:
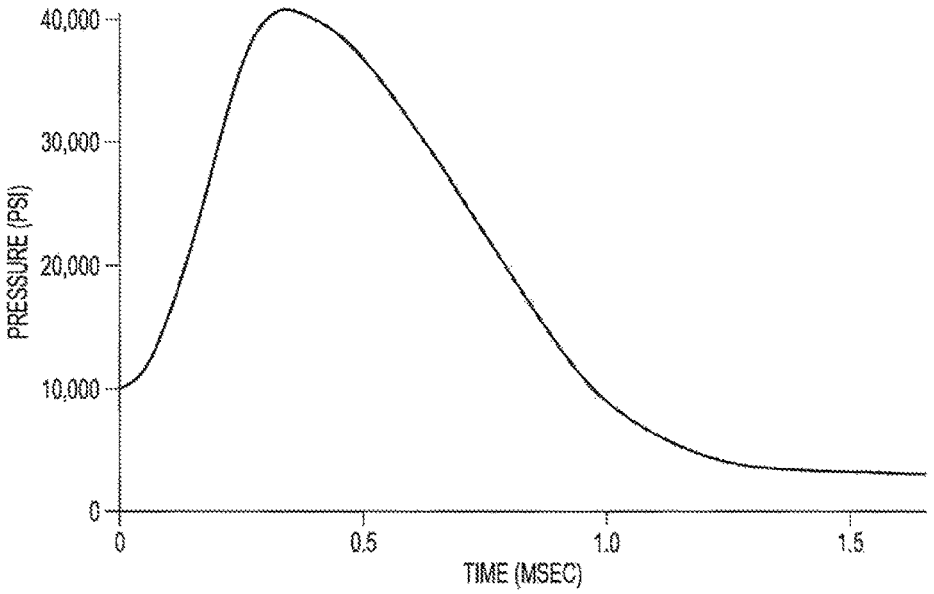
FIG. 15 PRIOR ART
FIG. 15 is a graph showing a pressure curve produced by a typical smokeless gunpowder.
Figure 16:
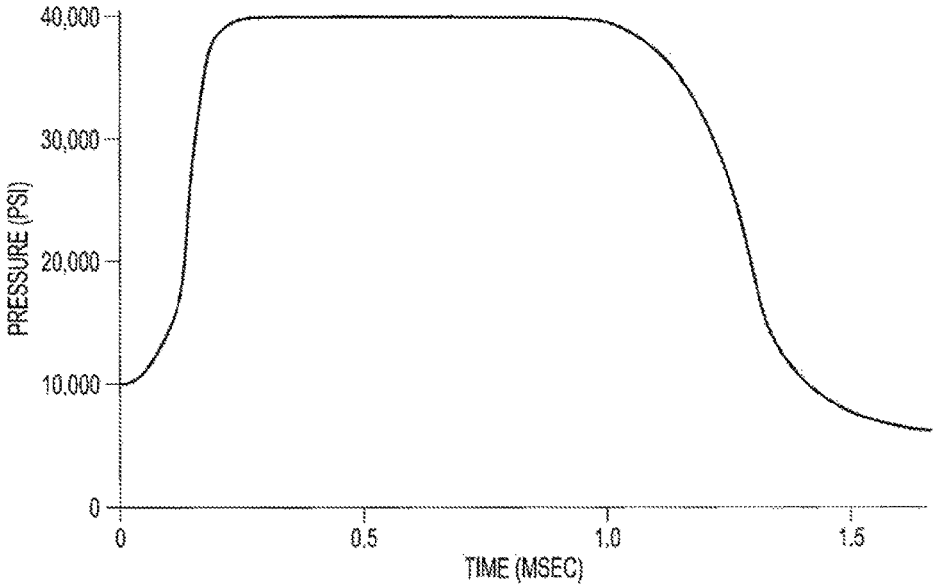
FIG. 16 is a graph showing a pressure curve that can be generated by utilizing an energetic material of FIG. 1 instead of traditional gunpowder.

In the case of a missile, for example, the missile 132 in FIG. 17, the energetic material 10 may be utilized for either the propellant 136, the payload 134, or both. Missiles are well known in the art of munitions, and are therefore not described in detail herein, except to point out the explosive payload 134 and propellant 136. If the propellant 136 is made from an energetic material 10, then the ignition system can be designed to provide a pressure curve similar to that of FIG. 16, although at a different pressure level, to maximize the area under the curve while keeping the maximum pressure below the safe pressure level. If the payload 134 is made from an energetic material 10, then the payload 134 may deliver 3-4 times as much energy as an equivalent volume of traditional high explosives. In either case, the energetic material will have excellent stability and therefore facilitate safe handling and transportation of the missile 132. In the event that neutralizing a missile or other device within which the energetic material is utilized becomes necessary, for example, if the missile is about to fall into the wrong hands, the timing of activation of individual ignition points can be particularly large, resulting in the slow burning of the metal oxide 12 and reducing metal 14, thereby neutralizing the energetic material and making the missile useless without creating a safety hazard.

Figure 19:
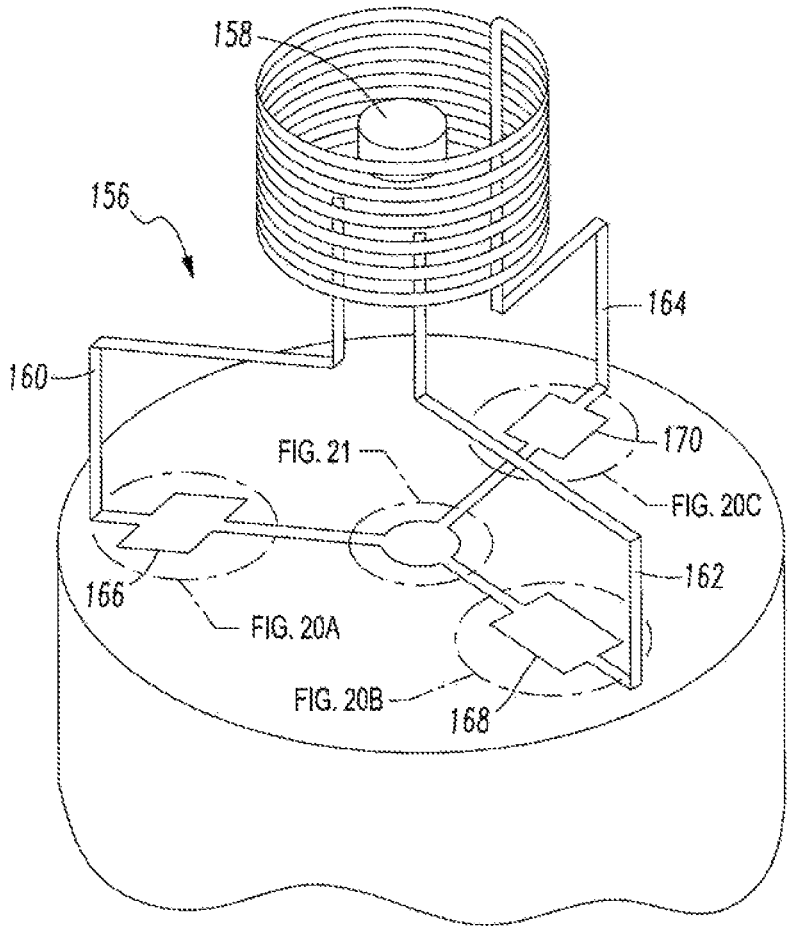
FIG. 19 is a diagrammatic view of an ignition system for a munition.
Figure 20A:
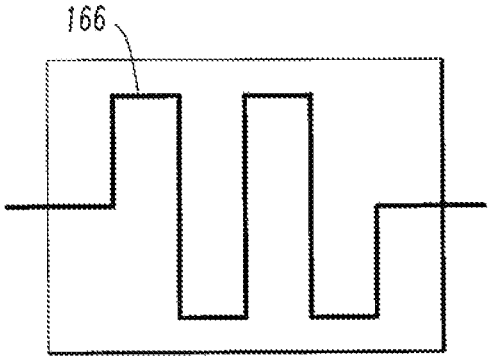
FIG. 20A is a schematic view of a fuse for the ignition system of FIG. 19.
Figure 20B:
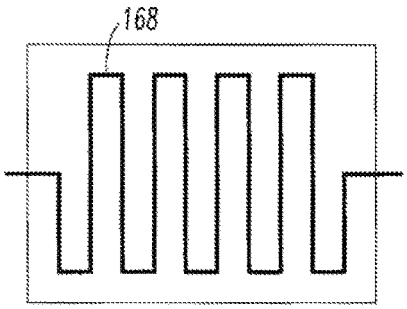
FIG. 20B is a schematic view of a fuse for the ignition system of FIG. 19.
Figure 20C:
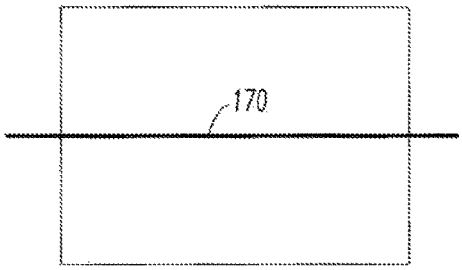
FIG. 20C is a schematic view of a fuse for the ignition system of FIG. 19.
Figure 21:
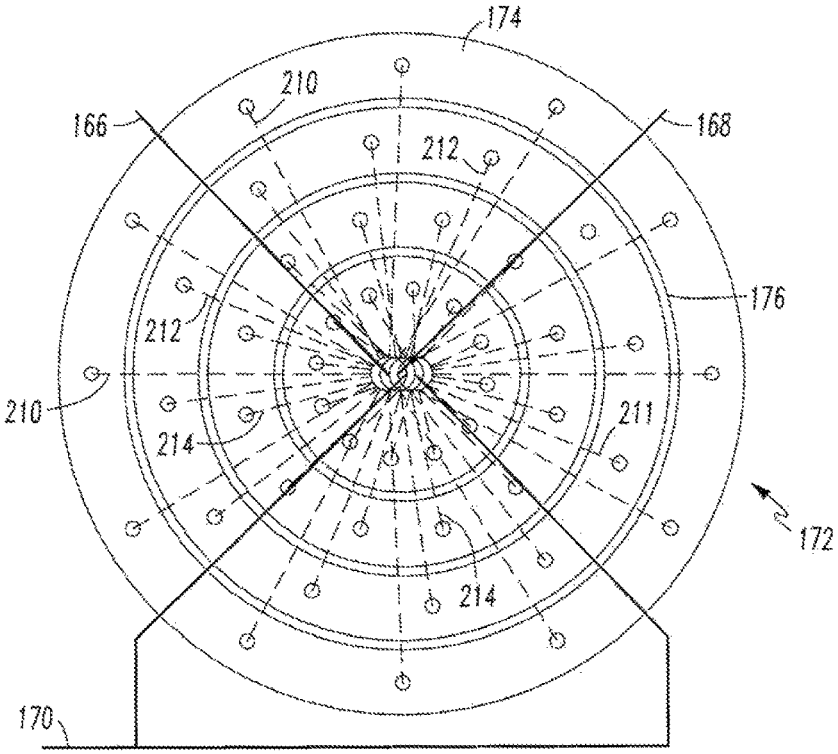
FIG. 21 is a schematic view of a detonator made from an energetic material having a layered structure.

FIGS. 19-21 illustrate an example of use of the energetic material 10 as a detonator for a munition. The illustrated example of the munition is a hand grenade, but the principles described herein can be utilized to detonate any other munition requiring a detonator. The illustrated example of the detonation system 156 includes a primer 158 for actuating the system. The upward movement of the handle of a hand grenade could be used to ignite the primer 158 in a manner that is well known in the art of hand grenades. The primer 158 is operatively connected to the fuses 160, 162, 164. The fuses 160, 162, and 164 are all different lengths. In the illustrated example, fuse 162 is the shortest of the three fuses. In the illustrated example, the fuse 164 is wrapped around the primer 158, and is therefore the longest of the three fuses. The fuses 160, 162, 164 are surrounded by appropriate insulating material, so that nothing else is ignited until the ends of the fuses are reached.

Each of the fuses 160, 162, 164 is connected to a secondary fuse 166 (FIG. 20A), 168 (FIG. 20B), 170 (FIG. 20C), respectively. The fuses 166, 168, and 170 utilize a meandering structure in order to accommodate different lengths of fuse within a small space. Fuse 168, which is operatively connected to the fuse 162, is the longest of the three secondary fuses. Fuse 170, which is operatively connected to the fuse 164, is the shortest of the three secondary fuses. The lengths of all of the fuses 160, 162, 164, 166, 168, 170, are structured so that, when the primer 158 is struck, the differing lengths of the fuses 160, 162, and 164 result in the ignition reaching the end of each of these fuses at a different time. However, the differing lengths of the fuses 166, 168, 170 is such that, despite the fact that the fuses 166, 168, 170 are ignited at different times by the fuses 160, 162, 164, the ignition will reach the ends of the fuses 166, 168, 170 at essentially the same time.

Referring to FIG. 21, a detonator 172 is illustrated. The detonator 172 has a structure very similar to that of FIG. 18. The detonator 172 is formed by alternating rings of energetic material 174 and gaps 176. Each of the fuses 166, 168, 170 includes a hub and spoke structure similar to that of FIG. 18, with the ends of the spokes 210, 212, 214 associated with each of the fuses 166, 168, 170, respectively, terminating at a different energetic material ring 174 within the detonator 172. In order to provide sufficient ignition of the detonator 172 to cause detonation of the munition, the ignition must reach the ends of the fuses 166, 168, 170 at the same time, so that the internal and external energetic material rings 174 are all ignited at the same time. The anticipated precision of the example fuse structure is about =/−0.1 second, which not only enhances the safety features described below, but also enhances the precision with which the detonation time of the munition can be known. If these rings are ignited at different times, then insufficient energy concentration will result from the ignition to detonate the munition, resulting in deflagration rather than detonation of the detonator and munition.

Because all three ignition paths must deliver the ignition to the detonator 172 at essentially the same time, the detonation system 156 has significant safety advantages. Because one and only one of the fuses 160, 162, 164 is wrapped around the primer 158, a bullet strike will only ignite the fuse 164, resulting in deflagration instead of detonation. The same result occurs if a bullet strikes either of the fuses 160, 162. The illustrated spacing of the fuses 160, 162, 164 minimizes any likelihood of a bullet striking more than one of these 3 fuses. A bullet or incendiary strike to the detonator 172 also results in deflagration. The risk of detonation in a fire is also substantially reduced.

Figure 22:
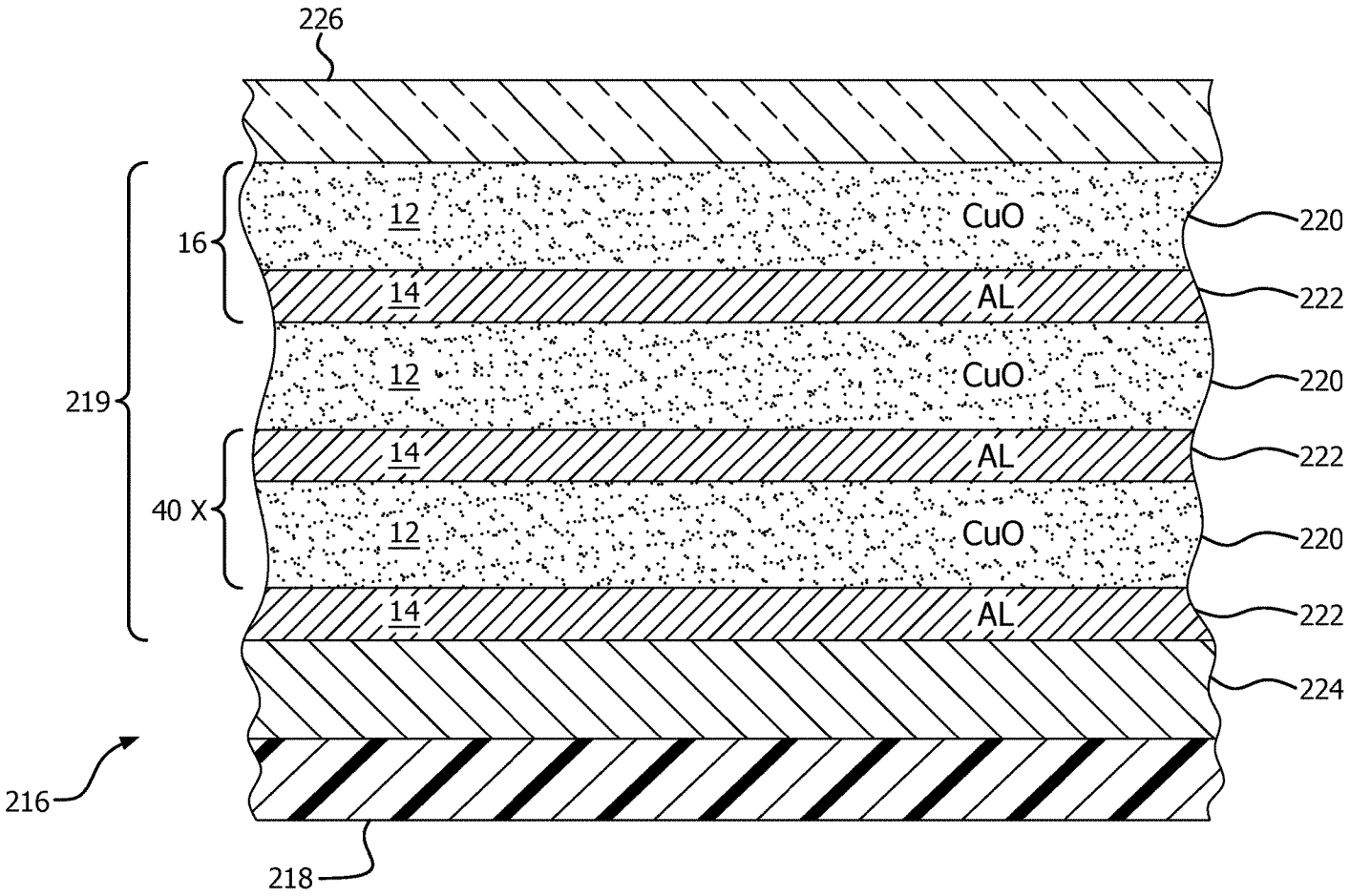
FIG. 22 is a schematic diagram showing a layered structure of an energetic material
Figure 23:
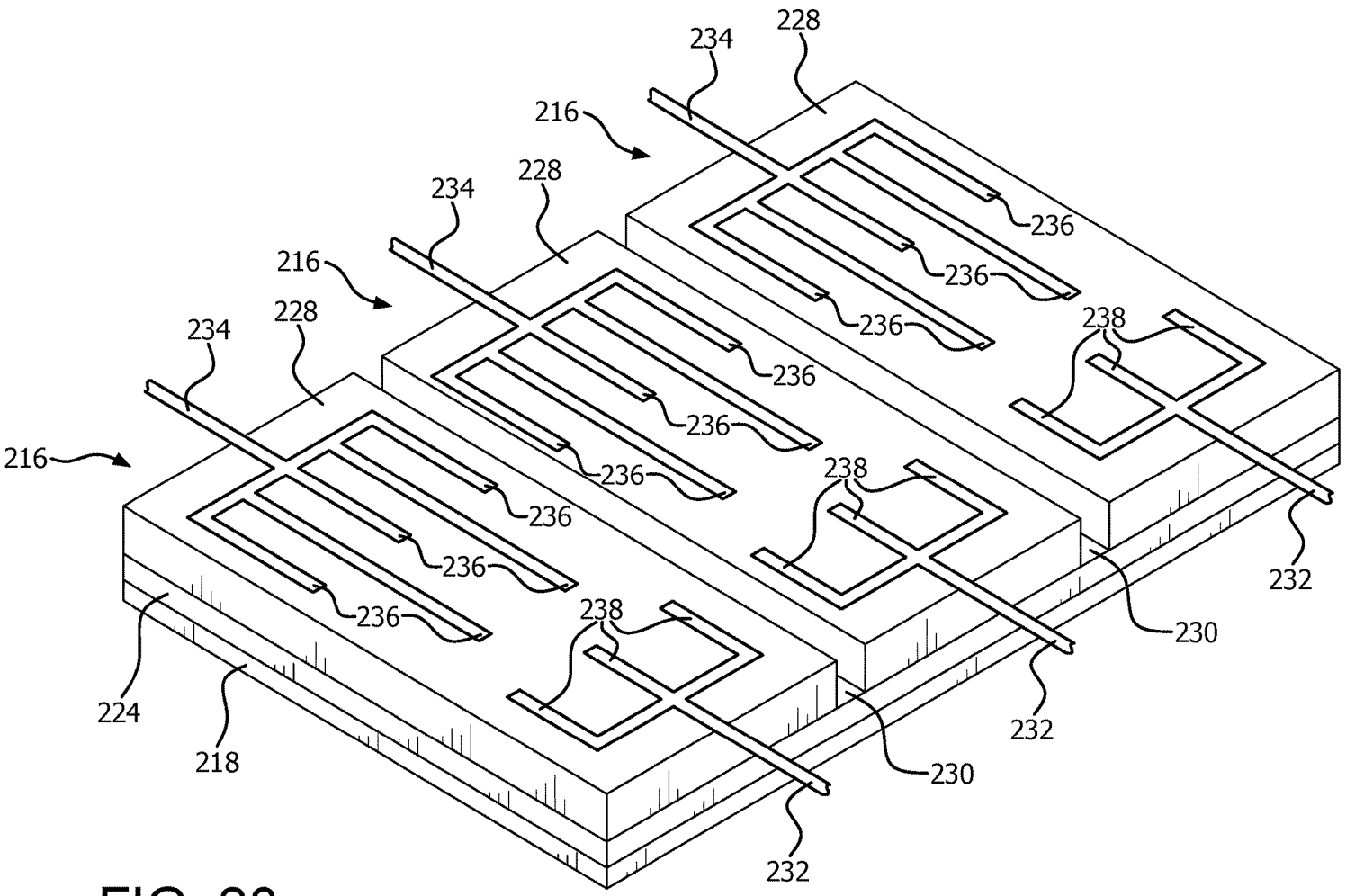
FIG. 23 is a perspective view of an energetic material of FIG. 22, showing an example of ignition signal conductors.
Figure 24:
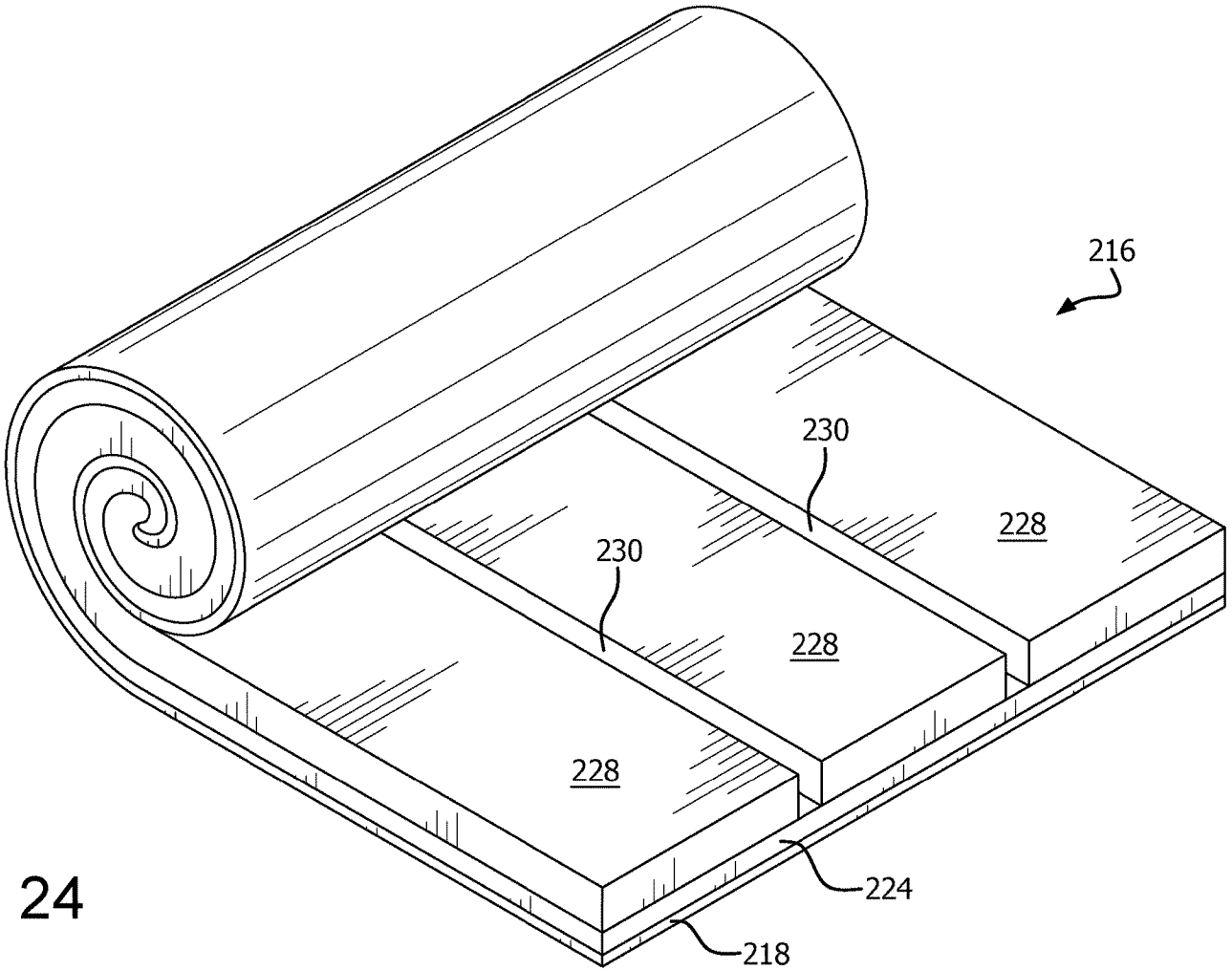
FIG. 24 is a perspective view of an energetic material of FIG. 23, showing the energetic material being rolled for use within a pressure vessel.

Referring to FIGS. 22-24, yet another example of an energetic material 216 is illustrated. The energetic material 216 can be used for any purpose described above, as well as the purposes described below. The energetic material 216 is similar to the energetic material described above, with the addition of a gas producing layer 218 in addition to the thermite 219. As described in greater detail below, the reaction between the metal oxide 220 and reducing metal 222 (which may also include the substrate 224 as one of the reactants in some examples) creates heat, causing the gas producing layer 218 to vaporize. A gas is produced as result of vaporizing the gas producing layer due to the heat from the thermite reaction. The production of this gas can be utilized to increase the pressure within a pressure vessel, for example, a fuel chamber or combustion chamber of a vehicle or missile, the payload of a missile or other munition, or the casing of a firearm cartridge. Ethylene vinyl acetate is an example of a suitable polymer, with one example being marketed by DuPont under the trademark ELVAX 410. Ethylene vinyl acetate can be obtained in the form of a flat sheet, which can be advantageous for the process of making the energetic material 216 as described below. Another example of a gas producing layer 218 can be made from nitrocellulose.

Although the illustrated example utilizes aluminum as the reducing metal and cupric oxide as the metal oxide, other combinations may be used. As one example, magnesium may be used instead of aluminum. As another alternative, an exothermic intermetallic reaction to form an intermetallic compound may be use. For example, a combination of titanium and boron, or titanium and a boron-containing material such as boron nitride or a boride of a refractory metal may be used as the reactants. The two reactants that undergo the exothermic reaction to produce an intermetallic pair shall be defined herein as an intermetallic reaction pair, with the individual reaction components being defined as the first reaction pair component and second reaction pair component. Thus, titanium is one example of a reaction pair component, and boron or a boron containing material is an example of a reaction pair component.

A method of making the energetic material 216 includes beginning with a substrate, for example, the aluminum sheet 224, and depositing alternating layers of metal oxide and reducing metal (or a combination of metals to be used in an intermetallic reaction) on the substrate 224. One method of depositing the thermite layers is by sputtering. Another method is physical vapor deposition. Yet another method is evaporative deposition, which is particularly suited to Specific methods described in U.S. Pat. No. 8,298,358, issued to Keven R. Coffey on Oct. 30, 2012, and U.S. Pat. No. 8,465,608, issued to Kevin R. Coffey on Jun. 18, 2013, are suited to depositing the alternating metal oxide and reducing metal layers in a manner that resists the formation of oxides between the alternating layers, and the entire disclosure of both patents is expressly incorporated herein by reference. Yet another method of depositing the energetic material onto the layer 218 is by three dimensional printing, which is expected to provide a very simple manufacturing process. Ignition points, conductors, and reactive lands, as described in greater detail above, can be created using any of these methods through lithography and deposition of the appropriate ignition structures after deposition of a layer in which a portion of an ignition point will be located. Creating these structures can be accomplished in the same manner as the creation of integrated circuits. A passivation layer 226 is provided above the thermite. The purpose of the passivation layer is to contain the thermite reaction by resisting the passage of sufficient heat to ignite a new thermite reaction beyond the passivation layer. The illustrated example of the passivation layer 226 is silicon nitride.

Once the deposition process is complete, then the gas producing layer 218 can be laminated to the substrate 224. The resulting energetic material 216 thus includes a combination of thermite 226 and a gas producing material 218. Multiple ignition points, as well as the necessary ignition signal conduction structures, and insulating structures between the ignition signal conductors and the thermite, have been formed within or on the thermite layer 220 through the deposition process. In some examples, the resulting flat sheet of energetic material 216 can be rolled to form a cylindrical structure.

In the example of FIG. 23, a plurality of sections 228 of thermite have been deposited upon the substrate 224, with gaps 230 defined therebetween. The gaps 230 may be open, as illustrated, or alternatively may contain the same material as the passivation layer 226. A first set of ignition conductors 232 and a second set of ignition conductors 234 are provided on each of the sections 228 of energetic material 216. Some examples of the ignition conductors 232, 234 may be fuses, as illustrated in FIG. 7 or FIG. 18. Other examples of the ignition conductors 232, 234 may be electrical signal conductors, as illustrated in FIGS. 8A and 8B, in which a positive and negative conductor terminate on opposite sides of a thin band 36 that is structured to be heated to ignition temperature by the passage of an electrical current. The second set of ignition conductors 234 includes a greater number of ignition points 236 than the first set of ignition conductors 226, which includes a smaller number of ignition points 238, so that the rate of ignition can be determined by activating either the ignition points 238 only for slower ignition, the ignition points 236 only for more rapid ignition, or all of the ignition points 236, 238 for the most rapid ignition. The passivation layer 226 covering each section 228 resists the thermite reaction within one section 228 initiating a thermite reaction in an adjacent section 228, thus permitting individual sections 228 to be ignited without necessarily igniting adjacent sections 228.

Because the energetic material 216 combines ignition at a timed, controlled rate from multiple ignition points with gas production, the energetic material 216 can serve as either the fuel, payload, or both for a missile or other munition. For example, the energetic material 216 may serve as either the fuel or payload for the missile of FIG. 17, regardless of whether the passivation layer 226 or gaps 30 are present. If the propellant 224 is made from an energetic material 216, then the ignition system can be designed to provide a pressure curve similar to that of FIG. 16, although at a different pressure level, to maximize the area under the curve while keeping the maximum pressure below the safe pressure level. If the payload 226 is made from an energetic material 216, then the payload 226 may deliver 3-4 times as much energy as an equivalent volume of traditional high explosives. In either case, the energetic material will have excellent stability and therefore facilitate safe handling and transportation of the missile 222. In the event that neutralizing a missile or other device within which the energetic material is utilized becomes necessary, for example, if the missile is about to fall into the wrong hands, the timing of activation of individual ignition points can be particularly large, resulting in a relatively slow ignition of the metal oxide and reducing metal, resulting in particularly slow gas production, thereby neutralizing the energetic material and making the missile useless without creating a safety hazard.

Figure 25:
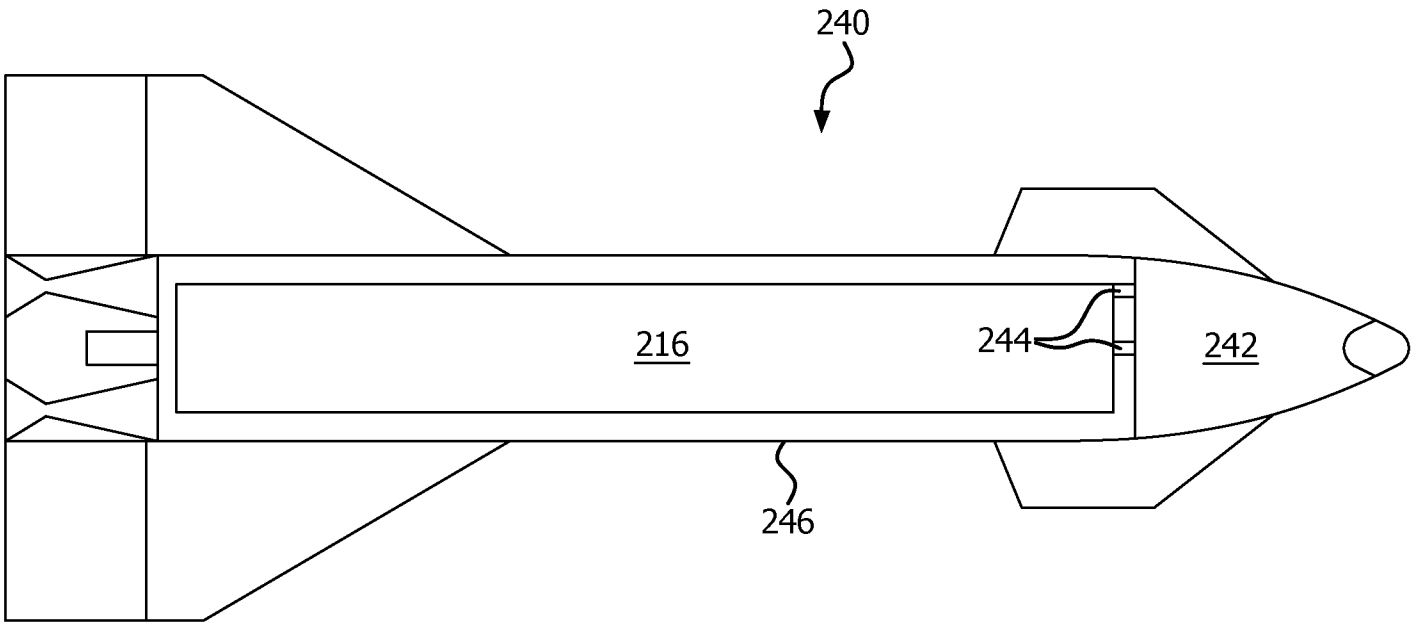
FIG. 25 is a cutaway side elevational view of a missile utilizing the energetic material of FIG. 22.

As another alternative, the energetic material 216 can serve as a combined fuel and payload for a missile 240 or other munition. Referring to FIG. 24, the substrate 224 as shown in FIG. 23 has been rolled into a cylinder, with the gaps 230 being oriented generally perpendicular to the longitudinal axis of the cylinder. Rolling the material in the direction generally perpendicular to the longitudinal axis of the cylinder maintains the function of keeping individual sections 228 sufficiently spaced so that individual sections 228 can be ignited without igniting adjacent sections 228. The illustrated example of the missile 240 of FIG. 25 utilizes this rolled cylindrical fuel. The guidance system 242 of the missile 240 is connected by ignition connectors 244 to each individual section 228 of energetic material 216. When the missile 240 is launched, the ignition points 238 of individual sections 228 can be ignited with a timing that will provide a pressure level close to the maximum safe pressure within the housing 246. Once a sufficient speed has been reached, additional sections 228 need not be ignited until the missile reaches its target. At this point, the ignition points 236, and possibly also the ignition points 238, of all remaining sections 228 are simultaneously activated, causing rapid ignition of the remaining energetic material 216, as well as rapid gas production and a rapid increase in pressure.

The energetic material therefore provides maximized contact between the metal oxide and reducing metal, providing for a rapid reaction, without significant lost volume due to oxide formation on the surface of the reducing metal. The energetic material has excellent stability, providing for safe handling and transportation of the energetic material as well as items containing the energetic material. The energetic material also provides 3-4 times the energy as an equivalent volume of traditional high explosives. An ignition system provides for controlling the timing and/or sequence of activation of multiple individual ignition points. The combination of the energetic material and ignition system provides a means of shaping a blast pattern and/or controlling the timing of pressure waves within a blast pattern. Additionally, the combination of the energetic material and ignition system provides a means of maximizing the area under a pressure curve while remaining below a maximum safe pressure of a pressure vessel within which the energetic material may be contained. Further, the energetic material provides a means of safely neutralizing the energetic material if necessary. In addition, the energetic material provides a means of enhancing the effects of conventional explosives. As yet another advantage, the energetic material provides a munition detonation system with an enhanced precision and safety. A further advantage of some examples of the energetic material is the inclusion of a gas producing layer which vaporizes upon ignition of the energetic material, thus increasing the pressure provided by the energetic material.

A variety of modifications to the above-described embodiments will be apparent to those skilled in the art from this disclosure. Thus, the invention may be embodied in other specific forms without departing from the spirit or essential attributes thereof. The particular embodiments disclosed are meant to be illustrative only and not limiting as to the scope of the invention. The appended claims, rather than to the foregoing specification, should be referenced to indicate the scope of the invention.

What is claimed is:

1. In combination, an energetic material and an ignition system, comprising:

a plurality of energetic layers, including at least a first layer comprising a metal oxide or a first reaction pair component, and a second layer comprising a reducing metal or a second reaction pair component the first layer having a first thickness, the first thickness being between about 5 nm and about 1,000 nm, the second layer having a second thickness, the second thickness being between about 5 nm and about 1,000 nm;

an interface between the first layer and second layer, the interface being either substantially free of metal oxide, or the interface being a metal oxide layer having an average thickness of less than 2 nm;

a gas producing layer, the gas producing layer being disposed in sufficiently close proximity to the energetic layers so that ignition of the energetic layers will vaporize the gas producing layer; and the combination being of unitary construction with the ignition system forming an ignition layer of the combination, the ignition layer having a plurality of ignition signal conductors within the ignition layer, the ignition system further having an ignition point corresponding to each ignition signal conductor, the ignition system being structured to provide an ignition signal to each ignition point at a predetermined time and with a predetermined sequence with respect to ignition signals provided to other ignition points.

2. The combination according to claim 1, further comprising a microprocessor, the microprocessor having an output pin operatively connected to each ignition point, the microprocessor being programmable to provide an ignition signal to each ignition point with a predetermined timing and sequence.

3. The combination according to claim 2, wherein the microprocessor is user-programmable.

4. The combination according to claim 1, further comprising a substrate disposed between the gas producing layer and one of the reducing metal layer, the first reaction component, the metal oxide layer, and the second reaction component.

5. The combination according to claim 4, wherein the substrate is made from a metal oxide, a first reaction component, a reducing metal, or a second reaction component.

6. The combination according to claim 4, wherein the gas producing layer is selected from the group consisting of ethylene vinyl acetate and nitrocellulose.

7. The combination according to claim 1, wherein the gas producing layer is selected from the group consisting of ethylene vinyl acetate and nitrocellulose.

8. In combination, an energetic material and an ignition system, comprising:

a plurality of energetic layers, including at least a first layer comprising a metal oxide or a first reaction pair component, and a second layer comprising a reducing metal or a second reaction pair component;

a gas producing layer, the gas producing layer being disposed in sufficiently close proximity to the energetic layers so that ignition of the energetic layers will vaporize the gas producing layer; and the combination being of unitary construction with the ignition system forming an ignition layer of the combination, the ignition layer having a plurality of fuses within the ignition layer, the ignition system further having an ignition point corresponding to each fuse, each fuse having a length that is proportional to a predetermined time interval between an original ignition signal and a desired ignition signal at each ignition point, whereby the ignition system provides an ignition signal to each ignition point at a predetermined time and with a predetermined sequence with respect to ignition signals provided to other ignition points.

9. In combination, an energetic material and an ignition system, comprising:

a plurality of energetic layers, including at least a first layer comprising a metal oxide or a first reaction pair component, and a second layer comprising a reducing metal or a second reaction pair component;

a gas producing layer, the gas producing layer being disposed in sufficiently close proximity to the energetic layers so that ignition of the energetic layers will vaporize the gas producing layer; and the combination being of unitary construction with the ignition system forming an ignition layer of the combination, the ignition layer having a plurality of ignition signal conductors within the ignition layer, the ignition system further having an ignition point corresponding to each ignition signal conductor, the ignition system being structured to provide an ignition signal to each ignition point at a predetermined time and with a predetermined sequence with respect to ignition signals provided to other ignition points;

a counting circuit, the counting circuit having a plurality of output bits; and wherein each ignition point is operatively connected to either an output bit or a at least one logical gate, with the logical gate being operatively connected to a combination of output bits, the output bit or combination of output bits corresponding to a predetermined time interval between an initial ignition signal and ignition of each ignition point.

10. In combination, an energetic material and an ignition system, comprising:

a plurality of energetic layers, including at least a first layer comprising a metal oxide or a first reaction pair component, and a second layer comprising a reducing metal or a second reaction pair component;

a gas producing layer, the gas producing layer being disposed in sufficiently close proximity to the energetic layers so that ignition of the energetic layers will vaporize the gas producing layer; and the combination being of unitary construction with the ignition system forming an ignition layer of the combination, the ignition layer having a plurality of ignition signal conductors within the ignition layer, the ignition system further having an ignition point corresponding to each ignition signal conductor, the ignition system being structured to provide an ignition signal to each ignition point at a predetermined time and with a predetermined sequence with respect to ignition signals provided to other ignition points;

a pressure vessel containing the energetic material, the pressure vessel being capable of withstanding a maximum safe internal pressure; and wherein the ignition system is structured to activate the ignition points with a time delay between successive ignition point activations that is structured to produce a pressure curve that rises to a pressure curve maximum, and then substantially maintains the pressure curve maximum without exceeding the maximum safe internal pressure.

11. The combination according to claim 10, further comprising means for activating the ignition points with sufficient time delay between successive activations to destroy the energetic material without rupturing the pressure vessel.

* * * * *